US011591779B2

(12) United States Patent
Currey et al.

(10) Patent No.: US 11,591,779 B2
(45) Date of Patent: Feb. 28, 2023

(54) MANIFOLD WITH INSERT FOR WATERWAY ASSEMBLY

(71) Applicant: Delta Faucet Company, Indianapolis, IN (US)

(72) Inventors: Don Currey, Chagrin Falls, OH (US); Earl Christian, Chagrin Falls, OH (US); Scott R. Gardner, Chagrin Falls, OH (US); Adam DeVries, Anderson, IN (US); Jonathan Lester, Burton, OH (US)

(73) Assignee: Delta Faucet Company, Indianapolis, IN (US)

( * ) Notice: Subject to any disclaimer, the term of this patent is extended or adjusted under 35 U.S.C. 154(b) by 0 days.

(21) Appl. No.: 17/342,072

(22) Filed: Jun. 8, 2021

(65) Prior Publication Data

US 2021/0388582 A1 Dec. 16, 2021

Related U.S. Application Data

(60) Provisional application No. 63/037,752, filed on Jun. 11, 2020.

(51) Int. Cl.
*E03C 1/04* (2006.01)

(52) U.S. Cl.
CPC ..... *E03C 1/0403* (2013.01); *E03C 1/0404* (2013.01)

(58) Field of Classification Search
CPC ..... E03C 1/0403; E03C 1/0404
See application file for complete search history.

(56) References Cited

U.S. PATENT DOCUMENTS

| | | | | |
|---|---|---|---|---|
| 7,766,043 | B2 | 8/2010 | Thomas et al. | |
| 7,819,137 | B2 | 10/2010 | Nelson et al. | |
| 8,365,770 | B2 | 2/2013 | Thomas et al. | |
| 8,944,093 | B2 * | 2/2015 | Veros | E03C 1/0403 4/677 |
| 8,985,146 | B2 | 3/2015 | Thomas et al. | |
| 8,991,425 | B2 | 3/2015 | DeVries et al. | |
| 9,611,945 | B2 * | 4/2017 | Kemp | F16K 19/006 |
| 9,951,880 | B2 | 4/2018 | Thomas et al. | |
| 2007/0271695 | A1 * | 11/2007 | Thomas | F16K 19/006 4/675 |
| 2008/0178950 | A1 * | 7/2008 | Marty | F16K 11/087 137/625.41 |

* cited by examiner

*Primary Examiner* — Patrick C Williams
(74) *Attorney, Agent, or Firm* — Bose McKinney & Evans LLP

(57) ABSTRACT

The disclosure described herein relates to waterway assemblies and manifolds for waterway assemblies for use in water fixtures such as, for example, faucets. Examples of the manifold for a waterway assembly of the present disclosure include an insert with a pair of inlet tubes which are offset from a supply tube. A method of manufacture for the waterway assembly and manifold having the insert with a pair of inlet tubes which are offset from a supply tube is also provided herein.

38 Claims, 21 Drawing Sheets

FIG. 15A
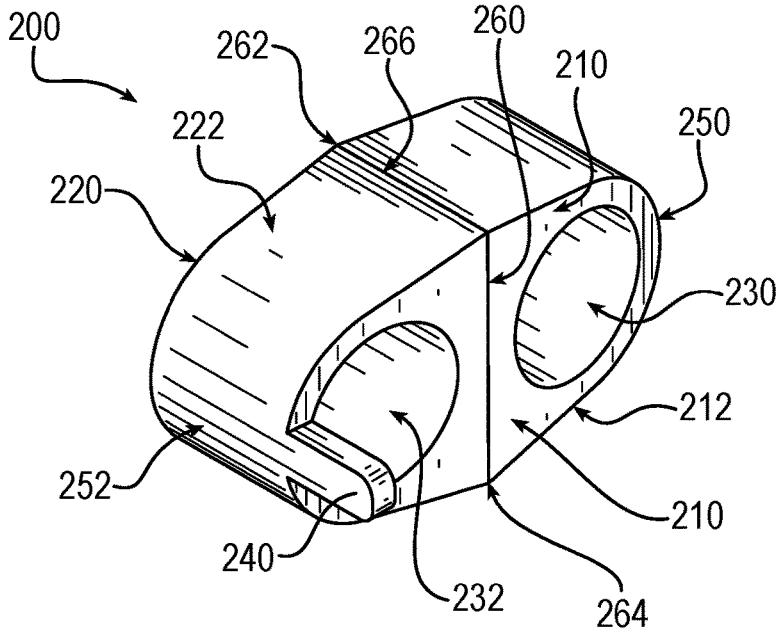
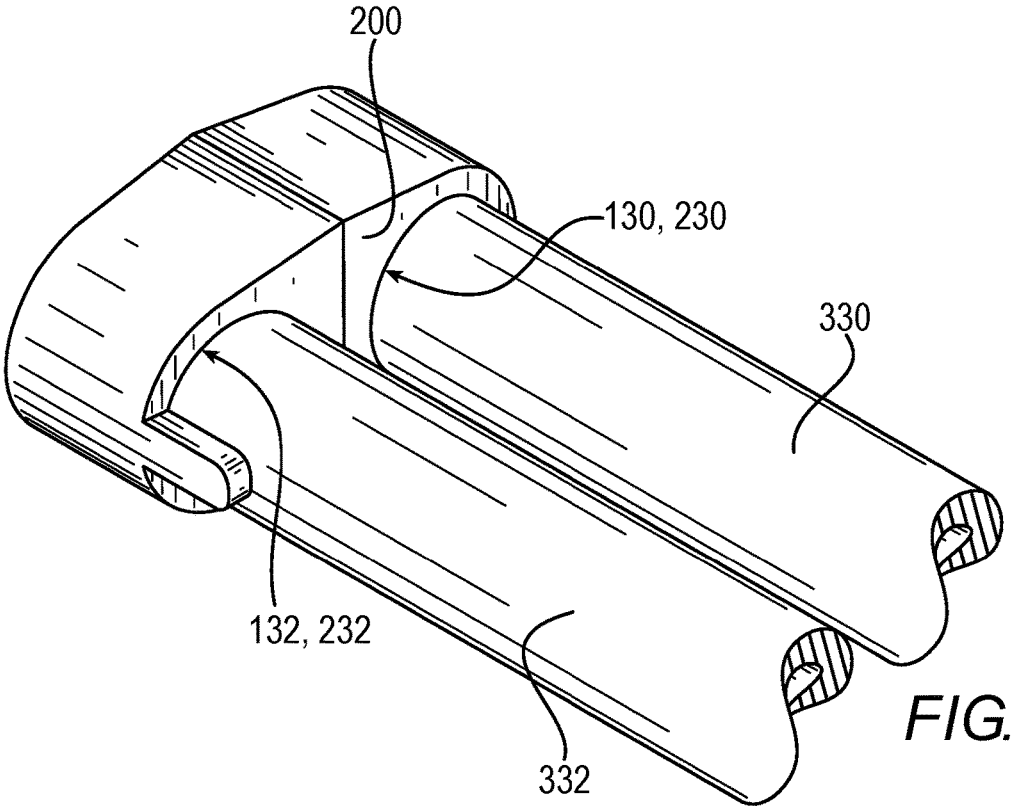
FIG. 15B

MANIFOLD WITH INSERT FOR WATERWAY ASSEMBLY

CROSS-REFERENCE TO RELATED APPLICATION

The present application claims priority to U.S. Provisional Patent Application Ser. No. 63/037,752, filed Jun. 11, 2020, the disclosure of which is expressly incorporated herein by reference.

BACKGROUND AND SUMMARY

This disclosure relates generally to waterway assemblies. More specifically, this disclosure relates to a manifold for use in a waterway assembly for water supply fixtures such as, for example, faucets.

Waterway assemblies are provided in fixtures to control, mix, and dispense water. Waterways may be found in fixtures such as faucets and include water inlet tubes, valves, and a supply tube. Modern waterway assemblies may be constructed of plastic components to reduce cost, weight, and corrosion otherwise exhibited by earlier components, such as metal, that are expensive to process, are heavy, and may corrode. Although brass components have been found to be an acceptable alternative, they are expensive and difficult to process in large quantities. In view of this, plastic is quickly becoming a viable alternative through manufacturing innovations and improved material properties.

Waterway assemblies usually include three tubes including a hot water inlet, a cold water inlet, and a supply. The hot water inlet, the cold water inlet, and the supply are consolidated and maintained within the waterway assembly at a manifold. In current manifolds for waterway assemblies, the tubes are often arranged in a singular row to accommodate their respective positions within the waterway assembly. The supply tube is positioned directly between the hot water inlet tube and the cold water inlet tube where the supply tube separates the hot water inlet tube from the cold water inlet tube. This is necessary to accommodate manufacturing processes and tolerances relied on to produce a single manifold in addition to providing proper access for the connections of each tube at the waterway assemblies. This, however, requires the width or diameter of the manifold be wide enough to accommodate each of these tubes positioned in a row with one another (and their combined outside diameters) which is done in a single molding step.

It is desirable to package these tubes into as small of a diameter as possible as the manifold diameter is typically the same as the valve cartridge diameter of the valve assembly. In view of the above, there is a need to decrease the size of the manifold and the waterway assembly to accommodate smaller fixtures, faucets and valve cartridges. Since a mold must close or wrap around 180 degrees of each tube, there is also a need to modify and improve the manufacturing process to accommodate a different size and arrangement of the manifold and the tubes positioned within the manifold for a waterway assembly.

The disclosure described herein relates to an apparatus and method of manufacture of a manifold for use in a waterway assembly for water supply fixtures such as, for example, faucets.

What is disclosed is a waterway assembly comprising: a manifold having a top side, a bottom side, a plurality of openings open through the top side and the bottom side and a recess formed in the bottom side. An insert is positioned in the recess of the manifold with a pair of openings of the plurality of openings extending therethrough, and a tube extending from each of the plurality of openings. The pair of tubes of the tubes extending from each of the plurality of openings are positioned within the insert. The first tube of the pair of tubes may be a hot water inlet tube and the second tube of the pair of tubes may be cold water inlet tube. A third tube may be a supply tube positioned in an opening within the manifold. The pair of inlet tubes may be offset from the supply tube and may further be offset from the insert in the manifold. The insert may be diamond shaped. The pair of inlet tubes and the supply tube extend from the manifold in the same direction.

The hot water inlet tube, the cold water inlet tube and the supply tube may form a triangular arrangement in the manifold. The supply tube may be orientated at an acute angle relative to the hot water inlet tube and the cold water inlet tube. The waterway assembly may further comprise a valve assembly wherein the valve assembly is in fluid communication with the plurality of openings at the top side of the manifold. A leak-proof connection may be formed between the manifold and the valve assembly by an annular sealing flange formed on the manifold. The leak-proof connection may be formed between the manifold and the valve assembly without an o-ring. The manifold may be 25 mm or less in diameter. The diameter of the manifold may be less than the diameter of each tube extending from each of the plurality of openings combined.

The manifold may be overmolded about the insert. The insert and the manifold may comprise polyethylene. The insert may be overmolded about the pair of tubes. The manifold may be overmolded about at least one tube and the insert. The tubes extending from the plurality of openings may comprise polyethylene.

What is also disclosed is a combined insert for a waterway assembly comprising: an insert body, a hot water inlet tube, and a cold water inlet tube wherein the hot water inlet tube and the cold water inlet tube are arranged adjacent one another within the insert body. The insert body may be configured to be inserted into a manifold having a supply tube independent and separate from the insert body for transferring water from the cold water inlet tube and the hot water inlet tube through a valve assembly to the supply tube. The hot water inlet tube and the cold water inlet tube may transfer a fluid through the insert body for mixing between a valve assembly and a manifold the combined insert is positioned within. The combined insert may further comprise a protrusion extending from a bottom side of the insert body and adjacent either the hot water inlet tube or the cold water inlet tube. The insert body may be overmolded about the hot water inlet tube and the cold water inlet tube. The insert body, the hot water inlet tube, and the cold water inlet tube may comprise polyethylene. The insert body may be diamond shaped.

What is further disclosed is a waterway assembly comprising: an insert, a hot water inlet tube, and a cold water inlet tube wherein the hot water inlet tube and the cold water inlet tube are arranged adjacent one another within the insert; a manifold having a top side, a bottom side, a plurality of openings open through the top side and the bottom side and a recess formed in the bottom side and the insert positioned in the recess of the manifold with the hot water inlet tube and the cold water inlet tube open through a pair of openings of the plurality of openings of the manifold; and a supply tube positioned within the manifold independent of the insert and offset from the insert. The insert may be diamond shaped. The hot water inlet tube, the cold water inlet tube, and the supply tube may extend from the manifold in the same direction. The hot water inlet tube, the cold water inlet tube, and the supply tube may form a triangular arrangement. The supply tube may be orientated at an acute angle relative to the hot water inlet tube and the cold water inlet tube.

The waterway assembly may further comprise a valve assembly wherein the valve assembly is in fluid communication with the hot water inlet tube, the cold water inlet tube, and the supply tube from the top side of the manifold. A leak-proof connection may be formed between the manifold and the valve assembly by an annular sealing flange formed on the manifold. The leak-proof connection may be formed between the manifold and the valve assembly without an o-ring. The manifold may be 25 mm or less in diameter. The diameter of the manifold may be less than the diameter of the hot water inlet tube, the cold water inlet tube, and the supply tube combined. The manifold may be overmolded about the insert. The insert and the manifold may comprise polyethylene. The insert may be overmolded about the hot water inlet tube and the cold water inlet tube. The manifold may be overmolded about the supply tube. The hot water inlet tube, the cold water inlet tube, and the supply tube may comprise polyethylene.

What is disclosed is a method of forming a waterway assembly including the steps of: providing a hot water inlet tube and a cold water inlet tube; securing an end of the hot water inlet tube and an end of the cold water inlet in an insert mold; overmolding an insert about the ends of the hot water inlet tube and the cold water inlet tube; removing the insert and the ends of the hot water inlet tube and the cold water inlet tube from the mold; providing a supply water tube; securing an end of the supply water tube and the insert in a manifold mold; and overmolding a manifold about the end of the supply water tube and the insert. The step of forming the insert may occur independent of the step of forming the manifold. The step of overmolding the manifold includes forming the manifold having a top side and a bottom side with a plurality of openings open through the top side and the bottom side, the supply tube extending from one of the openings of the plurality of openings, and a recess formed in the bottom side wherein the insert is located in the recess, and wherein the hot water inlet tube and the cold water inlet tube are in fluid communication with a pair of openings of the plurality of openings and the supply tube is offset from the insert. The hot water inlet tube, the cold water inlet tube, and the supply tube may be arranged in a triangular arrangement. The supply tube may be arranged at an acute angle relative the hot water inlet tube and the cold water inlet tube. The step of securing the insert in the manifold mold may further comprise positioning the insert relative to a protrusion on the insert to define the proper orientation of the insert within the manifold mold. The method of forming the waterway assembly may further comprise a step of forming an annular sealing flange on the manifold to form leak-proof connection when a valve assembly is connected to the manifold. The method of forming the waterway assembly may further comprise the step of crosslinking the waterway assembly.

The foregoing and other objects, features and advantages of the disclosure will be apparent from the following more detailed descriptions of particular examples of the disclosure, as illustrated in the accompanying drawings wherein like reference numbers represent like parts of the disclosure.

BRIEF DESCRIPTION OF THE DRAWINGS

Reference is made to the accompanying drawings in which particular examples and further benefits of the disclosure are illustrated as described in more detail in the description below, in which:

FIG. 15A is another bottom perspective view of an insert, in accordance with an example of the disclosure.

FIG. 15B is another bottom perspective view of an insert including tubes, in accordance with an example of the disclosure.

DETAILED DESCRIPTION

Examples of the present disclosure include a leak-proof manifold in a waterway assembly for a faucet. The leak-proof manifold is sealingly coupled to a valve assembly within a faucet to deliver water through the faucet by way of the waterway assembly. Water, as used herein, may refer to any fluid, generally, in the examples that follow. It is appreciated herein that a faucet may be relied on to deliver other fluids in various capacities. Therefore, it is appreciated herein that the use of the term water, as relied on herein, refers to fluids of other kinds that may be delivered through a faucet, or waterway assemblies in various arrangements.

A waterway assembly is a combination of components required to transfer water from one or more water supplies to a singular supply or outlet in a controlled manner. A waterway assembly may control the flow of water from the one or more water sources, control the temperature of water from the one or more water sources, control the delivery of water from the one or more water sources, a combination thereof, or the like. Faucets have such waterway assemblies for delivering water from water sources to other fixtures such as, for example, sinks, basins, tubs, or the like. Faucets, or waterway assemblies, may also be found in appliances and control the delivery of water from water sources through an appliance. Alternatively, an appliance may have a waterway assembly independent of a faucet wherein the waterway assembly of the present disclosure may also be provided directly within a fixture or appliance.

In a waterway assembly, a manifold may be coupled to a valve assembly for the controlled delivery of water from one or more water sources. More specifically, inlet tubes may be secured within the manifold for delivering water from the one or more water sources to the valve assembly. Inlet tubes may be a hot water inlet tube and a cold water inlet tube where hot water and cold water are delivered through the manifold and mixed and controlled by way of the valve assembly. A supply tube is further secured within the manifold for transferring the water that is delivered through the inlet tubes back through the manifold to a dispensing end of the waterway assembly. The valve assembly may mix the water from multiple water sources and/or control the flow of the water through the manifold, from the inlet tubes to the supply tube. The valve assembly, itself, is not a focus of the present disclosure. The present disclosure is directed to the leak-proof manifold, the components of the leak-proof manifold, the arrangement of the components of the leak-proof manifold, the arrangement between the manifold and the waterway assembly (including the arrangement with the valve assembly), and methods of manufacture for the manifold and its components.

Figure 1:
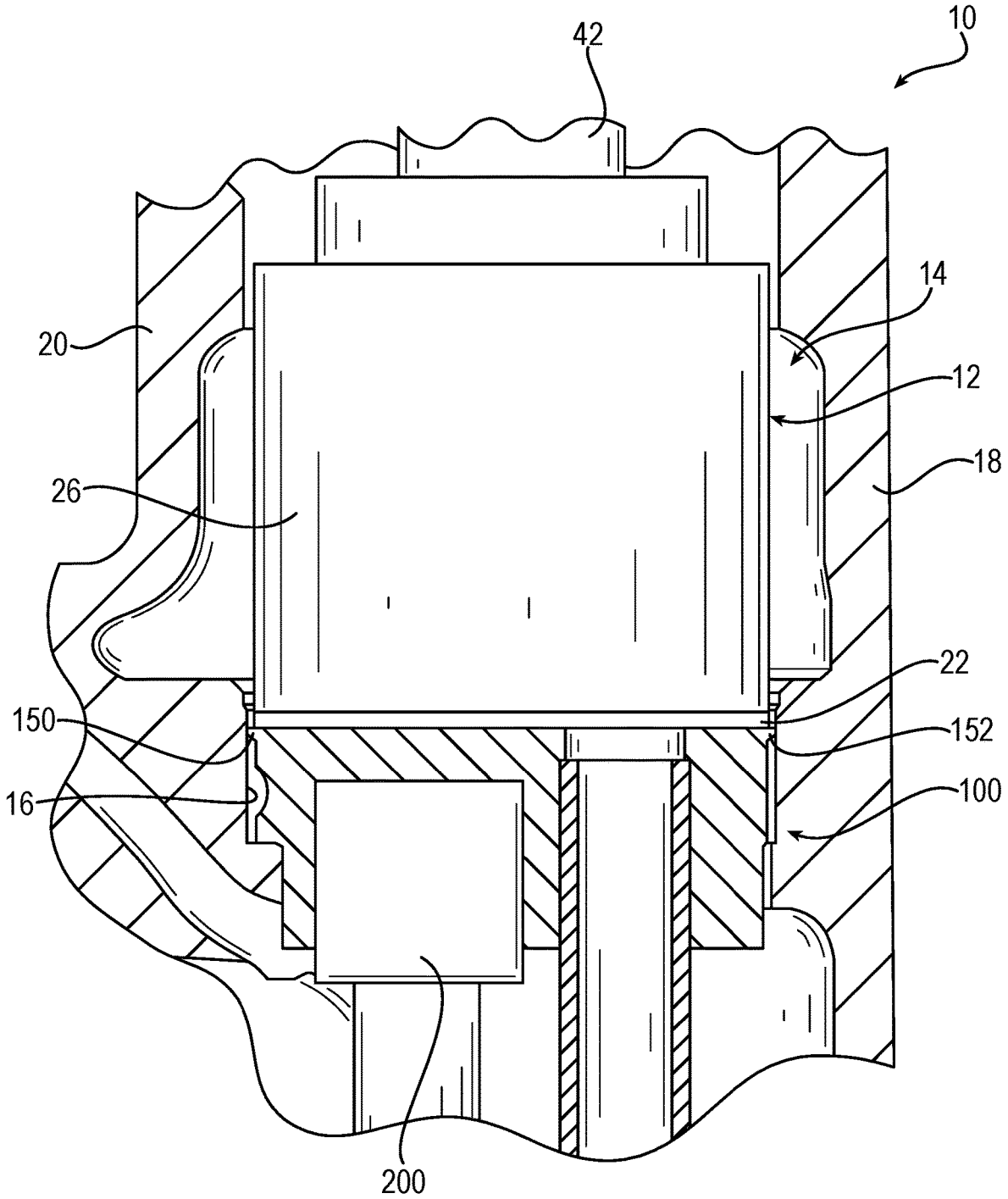
FIG. 1 is a side elevational view, in partial cross-section, of a faucet including a valve assembly interfacing with an illustrative manifold and insert of the present disclosure.
Figure 2:
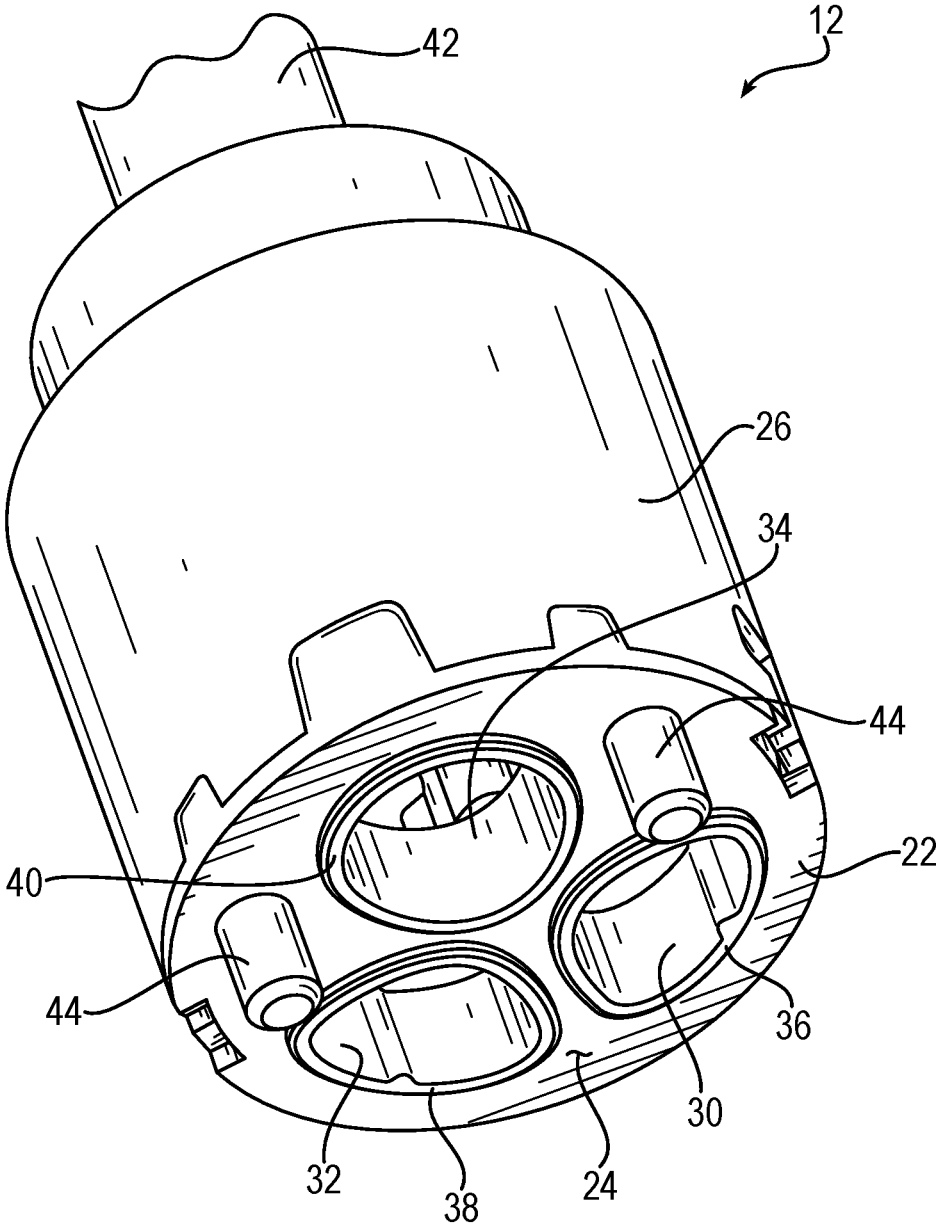
FIG. 2 is a bottom perspective view of the illustrative valve assembly of FIG. 1.

With reference initially to FIGS. 1 and 2, a faucet 10 is shown as including an illustrative manifold 100 of the present disclosure. A valve assembly 12 interfaces with the manifold 100 and may be received within a chamber 14 defined by an inner surface 16 of a valve body 18. In the illustrative embodiment, the valve body 18 may be defined by a spout 20 of the faucet 10. The valve assembly 12 includes a base 22 including a lower surface 24, and a cylindrical housing 26 extending upwardly from the base 22. A hot water opening or port 30, a cold water opening or port 32 and a supply or outlet water opening or port 34 are formed within the base 22. Seals 36, 38 and 40 are received by the base 22 around the openings 30, 32 and 34 to sealingly engage with the manifold 100. Conventional valve members, such as ceramic discs (not shown), are received within the housing 26 and control water flow from the hot and cold water openings 30 and 32 to the outlet opening 34 via user manipulation of a valve stem 42. Illustratively, locating projections or pins 44 extend downwardly from the base 22. In an illustrative embodiment, the valve assembly 12 comprises a conventional 25 millimeter ceramic mixing valve cartridge.

Figure 3:
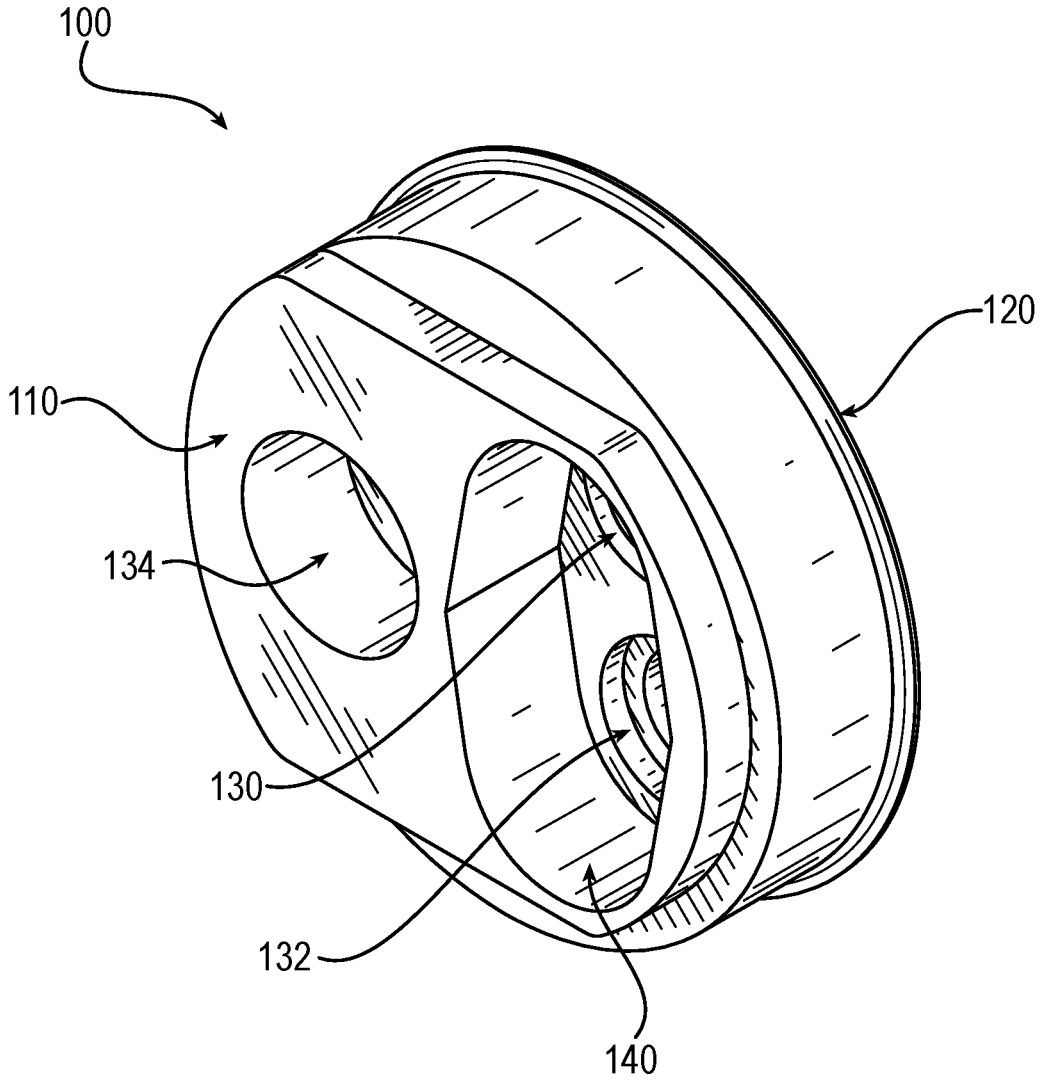
FIG. 3 is a bottom perspective view of a manifold, in accordance with an example of the disclosure.
Figure 4:
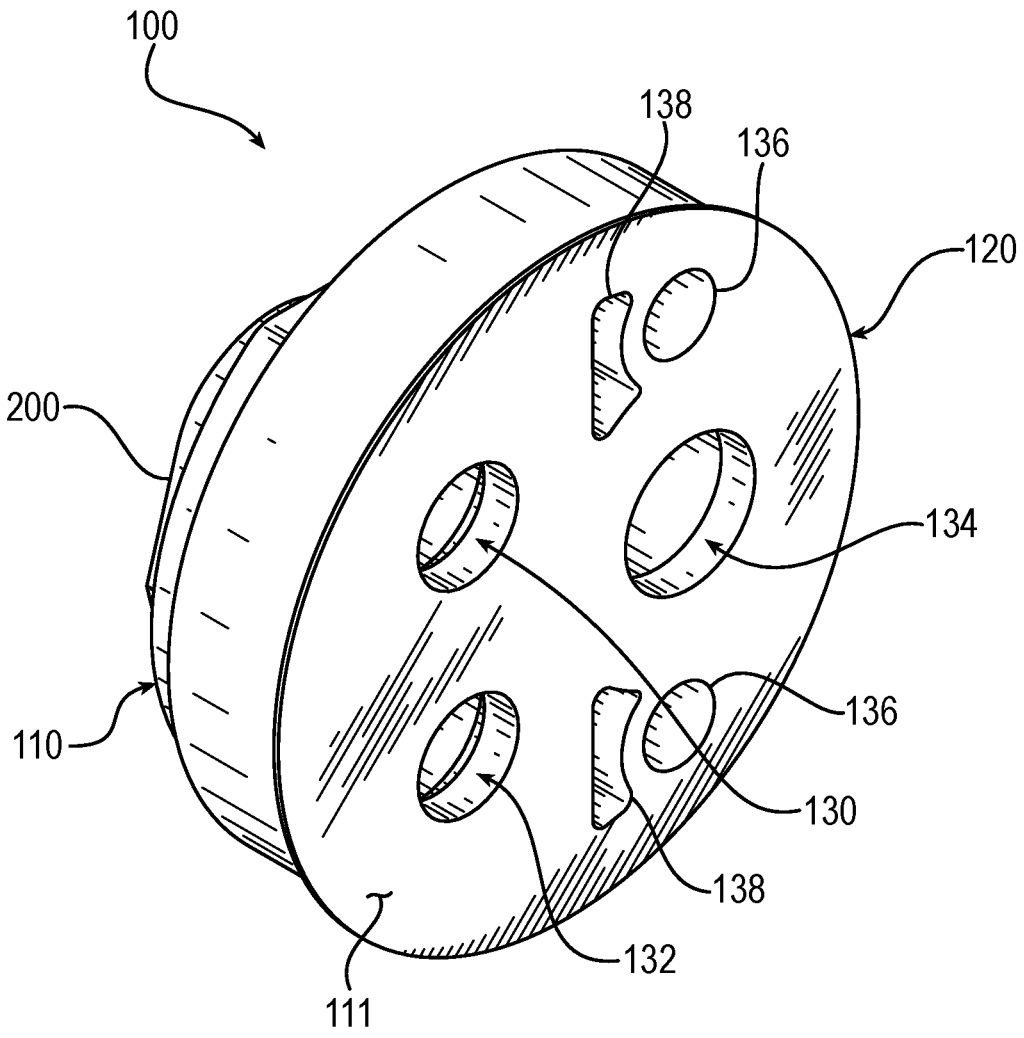
FIG. 4 is a top perspective view of a manifold, in accordance with an example of the disclosure.
Figure 5:
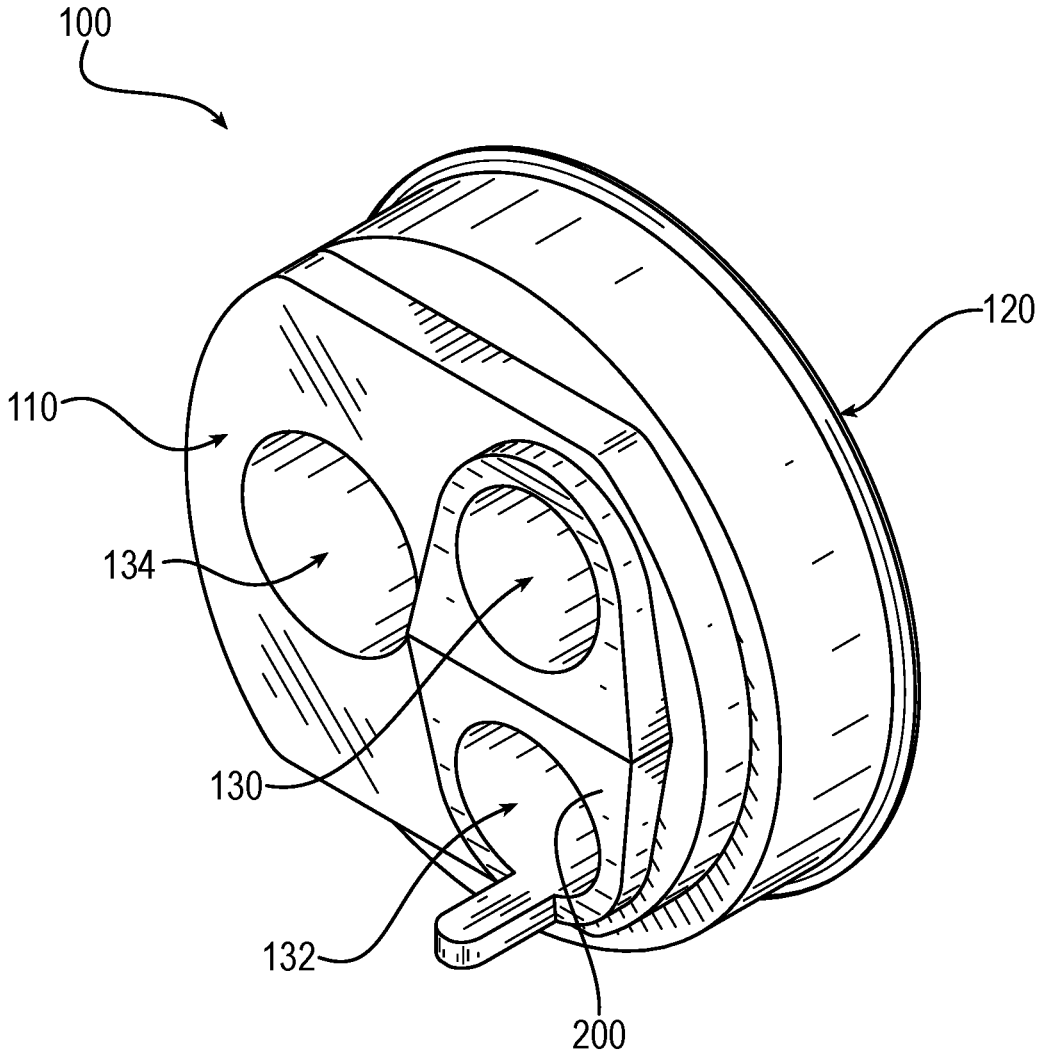
FIG. 5 is a bottom perspective view of a manifold and insert, in accordance with an example of the disclosure.

FIGS. 3-5 illustrate perspective views of a manifold 100 of the present disclosure. The manifold 100 has a bottom side 110, a top side 120, and a plurality of openings. FIG. 3 is a bottom side perspective view with a recess formed therein, FIG. 4 is a top side perspective view, and FIG. 5 is a bottom side perspective view with an insert positioned within the recess. A plurality of openings 130, 132, 134, or apertures, are open through the manifold from the bottom side 110 to the top side 120. As illustrated by FIG. 3, a recess 140 is formed in the bottom side 110 of the manifold 100. In examples herein, and as illustrated by FIG. 5, an insert 200, or second manifold, is positioned within the recess 140 of the manifold 100. In FIG. 5, a pair of the plurality of openings 130, 132 further extend through the insert 200 where the openings 230, 232, or apertures, extending through the insert are extensions of the openings 130, 132 extending through the manifold 100, as illustrated by FIGS. 3-4. An upper surface 111 sealingly engages with the lower surface 24 of the valve assembly 12, wherein the openings 130, 132, 134 of the manifold 100 are in fluid communication with the openings 30, 32 and 34 of the valve assembly 12. More particularly, seals 36, 38 and 40 are configured to engage with the upper surface 111 of the manifold 100. With reference to FIG. 4, receiving openings 136 are configured to receive the locating pins 44 of the valve assembly 12 to facilitate proper rotational orientation between the valve assembly 12 and the manifold 100. Relief areas 138 are formed within the upper surface 111 to reduce material during manufacturing to help avoid sinks and/or dimensional issues.

Figure 6:
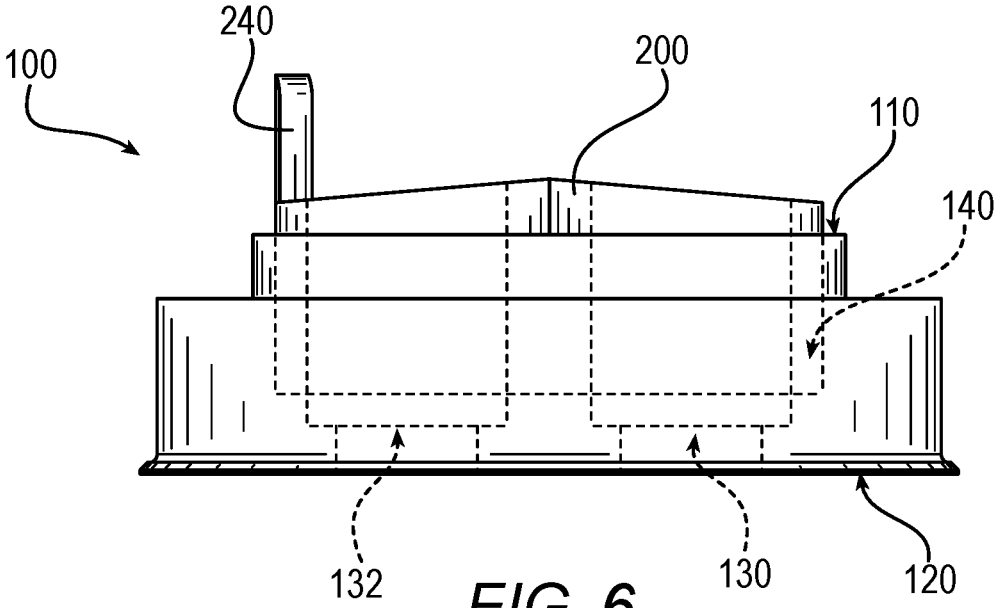
FIG. 6 is a side view of a manifold and insert, in accordance with an example of the disclosure.
Figure 7:
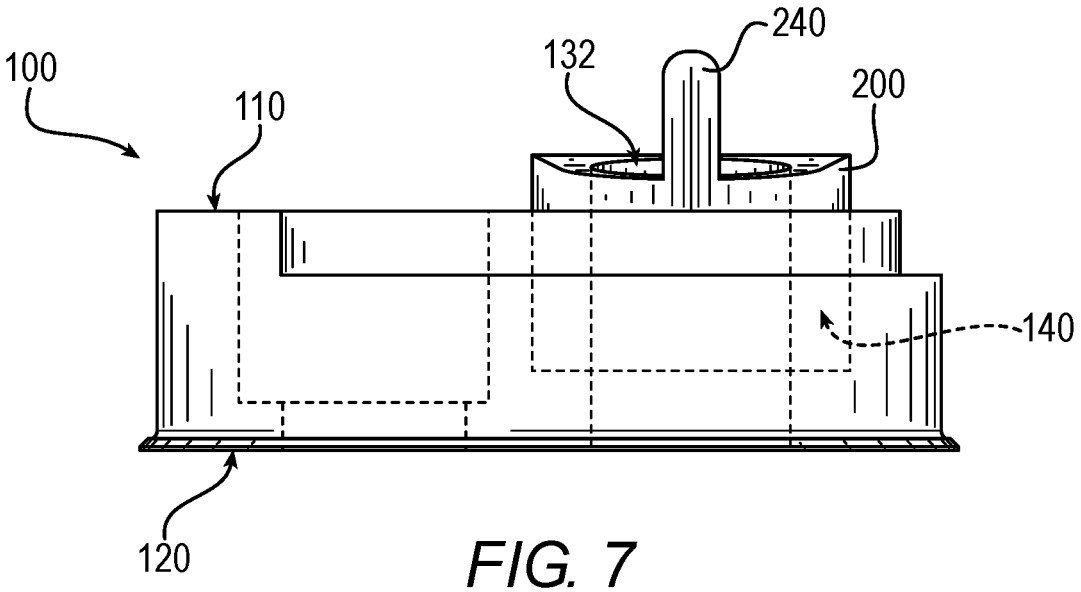
FIG. 7 is a side view of a manifold and insert, in accordance with an example of the disclosure.

FIGS. 6-7 are side views of the manifold 100 of FIG. 5. In FIG. 6, the manifold 100 is illustrated with the position of the insert 200 therein. Hidden lines identify the recess 140 of the manifold 100 wherein the insert 200 is positioned. Hidden/dashed lines also identify the pair of openings 130, 132, or apertures, extending through both the insert 200 and the manifold 100 and the continuity of the pair of openings 130, 132, or apertures, as they extend through both the insert 200 and the manifold 100. The insert 200 further comprises a protrusion 240 which provides a visual indicator to properly place the insert 200 (and tubes 330, 332) during the molding process of the manifold 100 as further described below. Like FIG. 6, FIG. 7 illustrates the position of the insert 200 within the manifold 100. Hidden/dashed lines identify one of the pair of openings 132, or apertures, as it extends through both the insert 200 and the manifold 100. The recess 140 of the manifold 100, into which the insert 200 is positioned, is also defined by hidden/dashed lines. FIG. 7 also illustrates one of the plurality of openings 130, or apertures, otherwise extending through the manifold 100 from the bottom side 110 to the top side 120.

Figure 8:
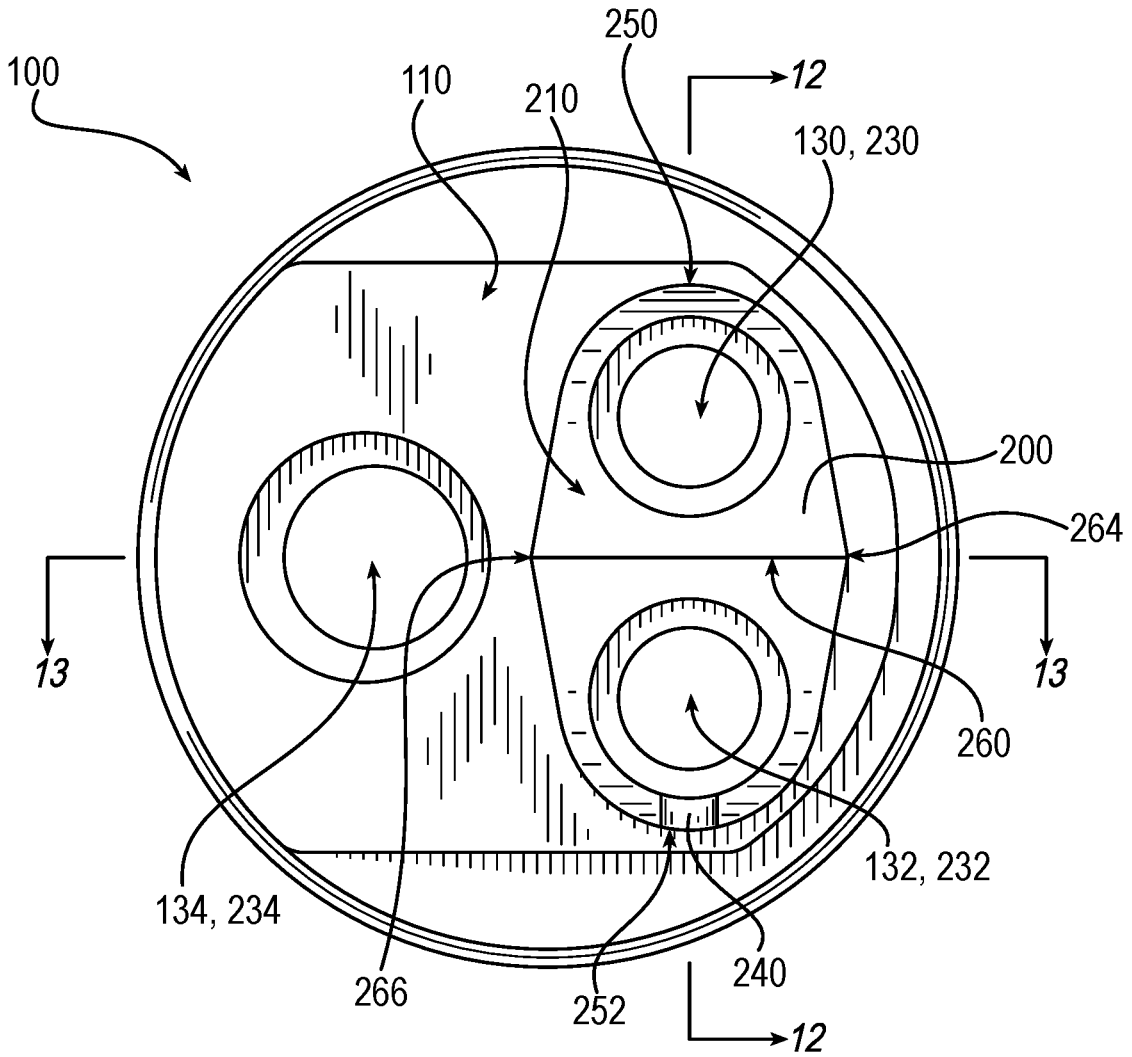
FIG. 8 is a bottom view of a manifold and insert, in accordance with an example of the disclosure.
Figure 9:
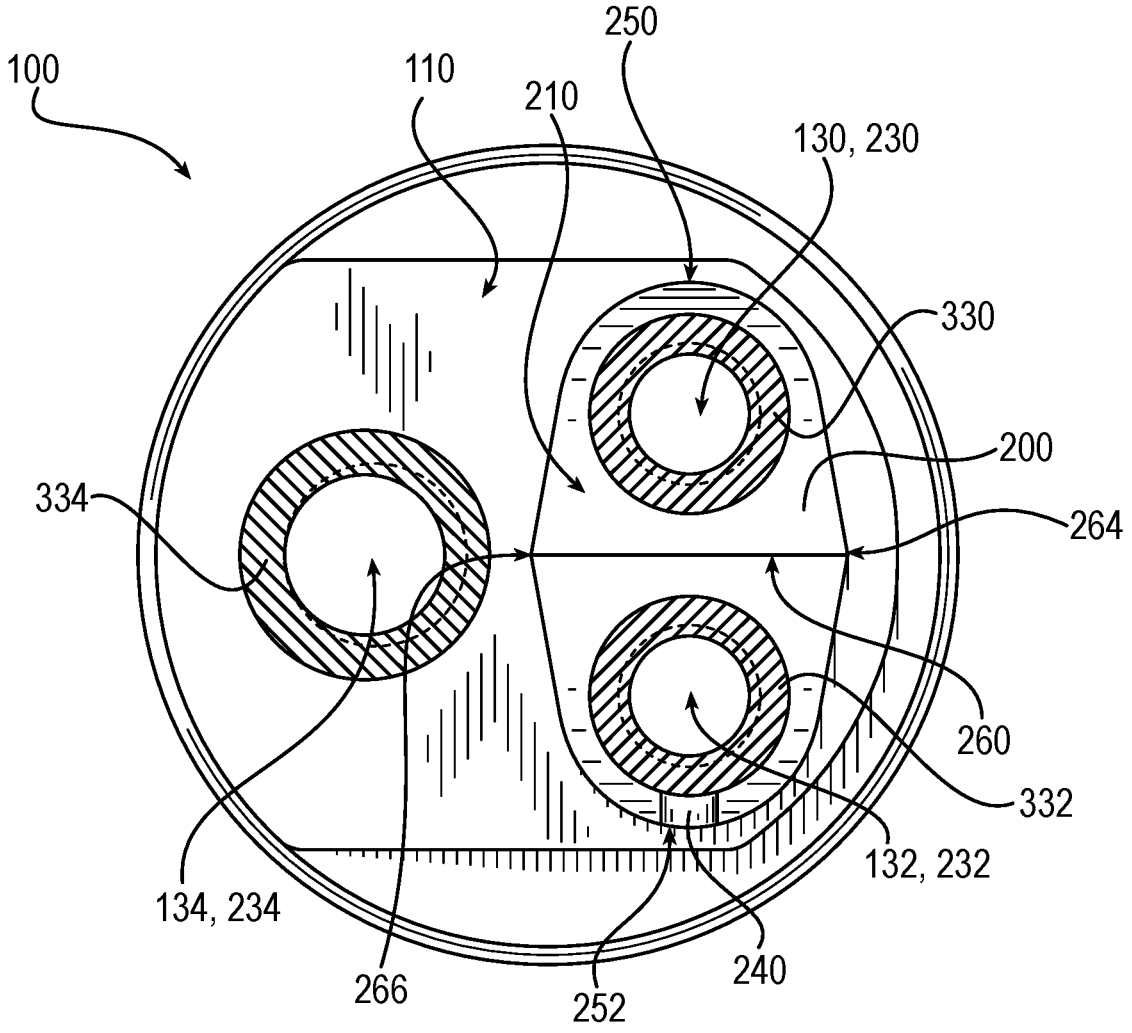
FIG. 9 is a bottom view of a manifold and insert, including tubes shown in cross-section, in accordance with an example of the disclosure.

Turning now to FIGS. 8 and 9, the bottom side 110 of the manifold 100 with an insert 200 is illustrated. The plurality of openings 130, 132, 134, or apertures, (including the pair of openings 230, 232, or apertures, of the insert) are illustrated with tubes 330, 332, 334 therein. The tubes extend from the bottom side 110 of the manifold 100 and/or the top side 210 of the insert 200. In one example, the tubes 330, 332 positioned within the insert 200 are inlet tubes 330, 332. The inlet tubes may be a hot water inlet tube 330 and a cold water inlet tube 332. Please note that the openings 230, 232, or apertures, of the insert 200 and/or the inlet tubes 330, 332 positioned within the insert 200 are not limited to a pair of openings or a pair of tubes, respectively. The insert 200 may possess a single opening, or aperture, a single tube, more than two openings (e.g. a plurality), or apertures, more than two tubes (e.g. a plurality), depending upon the use of the manifold.

In FIG. 9, inlet tubes 330, 332 are positioned within the pair of openings 230, 232, or apertures, extending through the insert 200. The inlet tubes 330, 332 may be positioned within and extend through the pair of openings 230, 232, or apertures, of the insert 200, only. Alternatively, the inlet tubes 330, 332 may be positioned within and extend through the pair of openings 130, 132, or apertures, of the manifold 100 and the pair of openings 230, 232, or apertures, of the insert 200. The tube 334 positioned within the manifold 100, independent of the insert 200, also extends from the bottom side 110 of the manifold 100 and is positioned within one of the plurality of openings 134 of the manifold. Here, similar to the tubes 330, 332 and openings 230, 232 of the insert 200, a tube 334 and/or opening 134 positioned within the manifold 100, independent of the insert 200, is not limited to a singular opening or tube. Multiple tubes and/or openings may be provided in the manifold 100, independent of the insert 200 based upon the functionality of the manifold 100. The tube 334, independent of the insert 200, may be a supply tube 334, or outlet tube, for supplying water from the inlet tubes 330, 332 to the faucet.

In FIG. 8, the insert 200 is generally diamond shaped at the bottom side 210. In this example, the diamond shape extends the entire depth of the insert 200. Each apex 250, 252 of the diamond shape follows the contour of the diameter of the pair of tubes 330, 332 and pair of openings 230, 232 extending through the insert 200 at opposing sides of the insert. The diamond shape thickens between the pair of tubes 330, 332 and pair of openings 230, 232 across the bottom side 210 of the insert 200 as well as the depth of the insert 200. As will be described in greater detail below with respect to FIGS. 13-18 the thickened section creates peaks 260, 262, 264, 266. The protrusion 240 extends from the bottom side 210 of the insert 200 to, at least, one of the apex 252 of the insert between the perimeter of the insert 200 and the tube 332.

FIG. 9 also illustrates the supply tube 334 positioned within the manifold 100, that is independent of the insert 200, is further offset from the insert 200, the pair of openings 130, 132 of the manifold 100, the pair of openings 230, 232 of the insert 200, and/or the inlet tubes 330, 332. This allows inlet tubes 330, 332 within the insert 200 to be positioned within the insert 200 independent of the supply tube 334 of the manifold, as further described below. This also allows the inlet tubes 330, 332 within the insert 200 to be positioned adjacent one another, in a side-by-side arrangement, wherein the size of the manifold 100 or the insert 200, across the bottom side 110 of the manifold and/or across the bottom side 210 of the insert, is limited to more than the combined diameter of the inlet tubes 330, 332 but less than the combined diameter of inlet tubes 330, 332 and an additional supply tube 334. This further provides a reduced manifold 100 dimension at the bottom side 110 of the manifold 100 (e.g., diameter, width, or the like). In specific examples the manifold 100 has a diameter of 25 mm or less.

The supply tube 334 and opening 234 that is offset from the insert 200, the openings 230, 232 of the insert 200, and/or the inlet tubes 330, 332 form a triangular arrangement relative to the insert 200, the openings 230, 232 of the insert 200, and/or the inlet tubes 330, 332. In other words, the supply tube is offset from the openings 230, 232 of the insert 200, and/or the inlet tubes 330, 332 while being positioned between the openings 230, 232 of the insert 200, and/or the inlet tubes 330, 332 in this offset arrangement. In one example, a triangle may be formed between each radial axis of the supply tube 334 or the radial axis of the opening 134 within the manifold, the radial axis of the hot water inlet tube 330 or the radial axis of openings 130, 230, and the radial axis of the cold water inlet tube 332 or the radial axis of openings 132, 232. In one example, an acute triangle may be formed with acute angles at each triangle endpoint. The acute triangle may be further an equilateral triangle. In another example, a 90 degree angle may be formed at the endpoint of the triangle formed at the radial axis of the opening 134 or supply tube, thereby forming a right triangle. The right triangle may be further an isosceles triangle.

Figure 10:
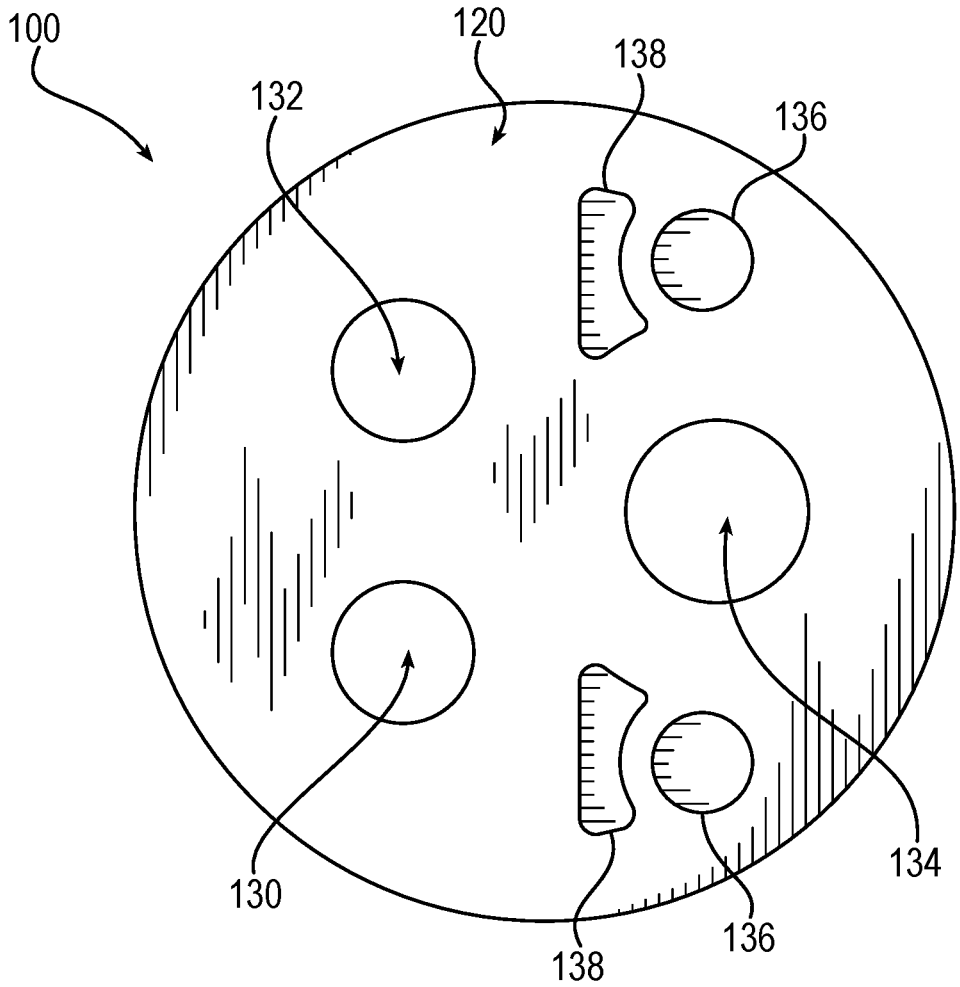
FIG. 10 is a top view of a manifold, in accordance with an example of the disclosure.
Figure 11:
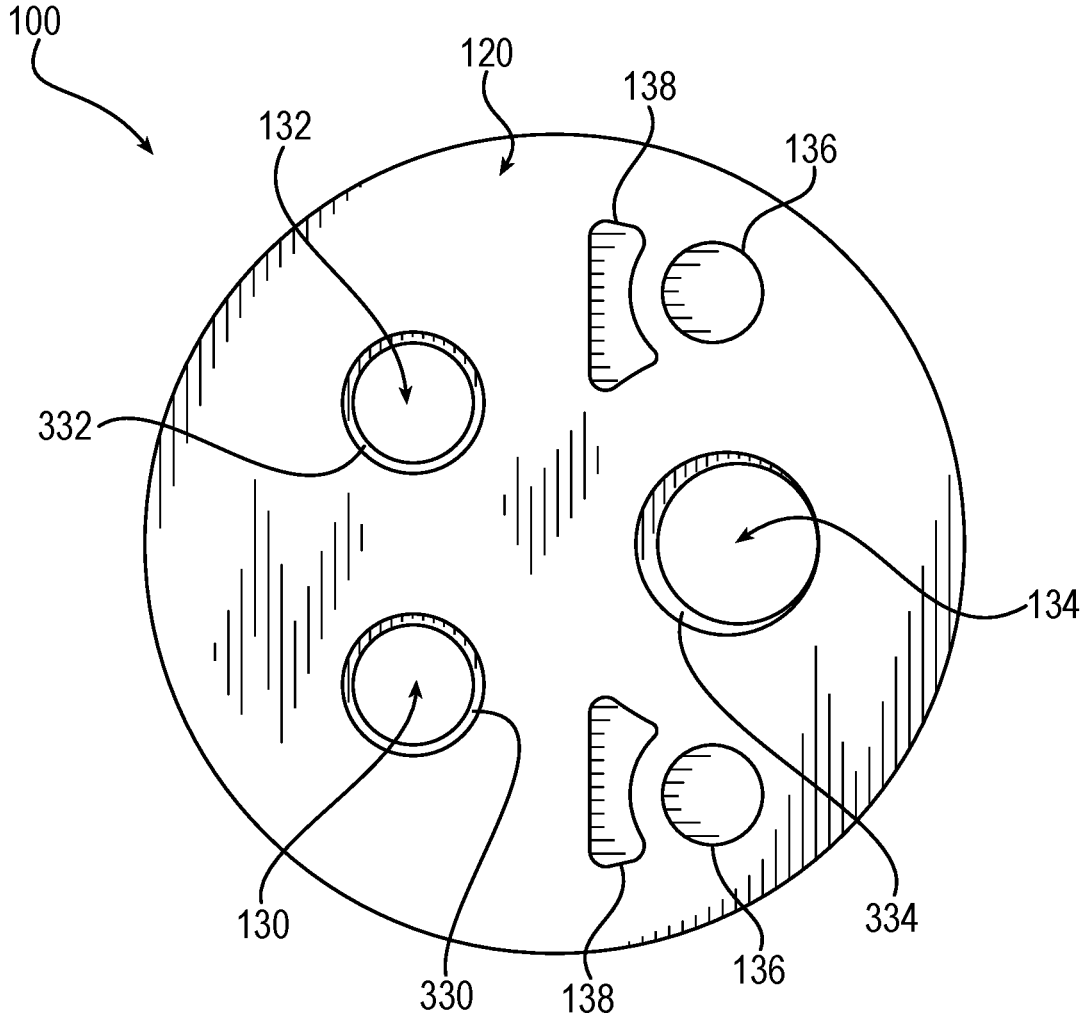
FIG. 11 is a top view of a manifold, in accordance with an example of the disclosure.

Turning now to FIG. 10, the top side 120 of the manifold 100 is illustrated. The plurality of openings 130, 132, 134, or apertures, are illustrated. In this example, the tubes (not shown) are seated above the top side 120 of the manifold 100 within each respective opening of the plurality of openings 130, 132, 134, or apertures, of the manifold 100, with tubes 330, 332, 334 therein. In other examples, the tubes 330, 332, 334 may extend entirely through the respective opening of the plurality of openings 130, 132, 134, such as shown in FIG. 11. In one specific example, the tubes 330, 332, 334 terminate at the top side 120 of the manifold 100. Also, as illustrated here the insert 200 does not extend the entire depth of the manifold 100. Instead, and as illustrated by FIGS. 6 and 8, the insert 200 is recessed in the bottom side 110 of the manifold 100.

Figure 12:
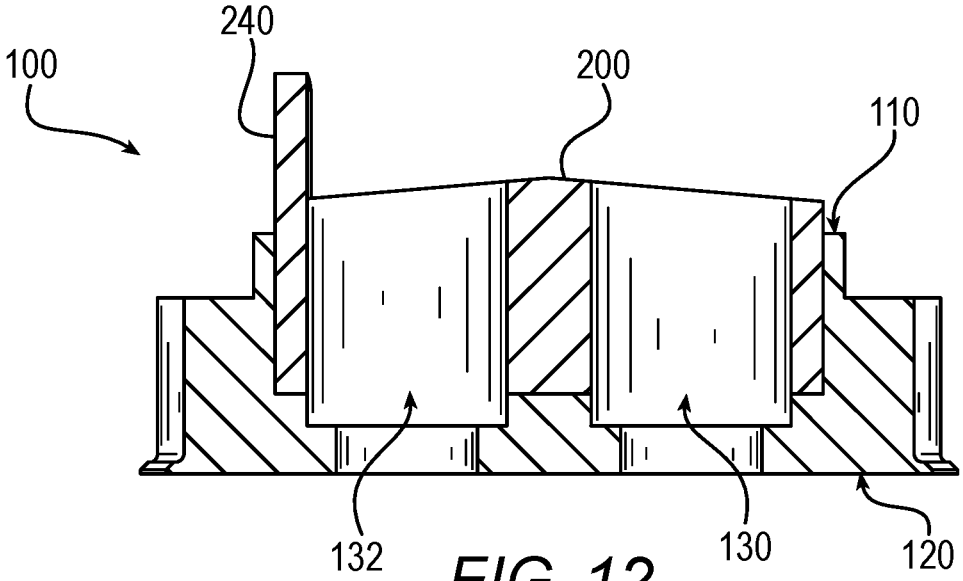
FIG. 12 is a cross-section of a manifold taken at line 12-12 of FIG. 8, in accordance with an example of the disclosure.

FIG. 12 is a cross-section of a manifold 100 taken at line 12-12 of FIG. 8. The insert 200 is positioned within the recess 140 of the manifold. The recess 140 is formed in the bottom side 110 of the manifold 100. A pair of the plurality of openings 130, 132 further extend through the insert 200 where the openings 230, 232, or apertures, extending through the insert are extensions, and are open to, of the openings 130, 132 extending through the manifold 100. Inlet tubes 330, 332 are positioned within the pair of openings 230, 232, or apertures, extending through the insert 200. In this example, the inlet tubes 330, 332, extend through the openings 230, 232 of the insert and are further seated within the manifold 100 below the insert 200. The inlet tubes, however, do not fully extend through the manifold 100 to or through the top side 120 of the manifold 100. In some examples, the inlet tubes 330, 332 may be positioned within and extend through the pair of openings 230, 232, or apertures, of the insert 200, only. Alternatively, the inlet tubes 330, 332 may be positioned within and extend through the pair of openings 130, 132, or apertures, of the manifold 100 and the pair of openings 230, 232, or apertures, of the insert 200.

Figure 13:
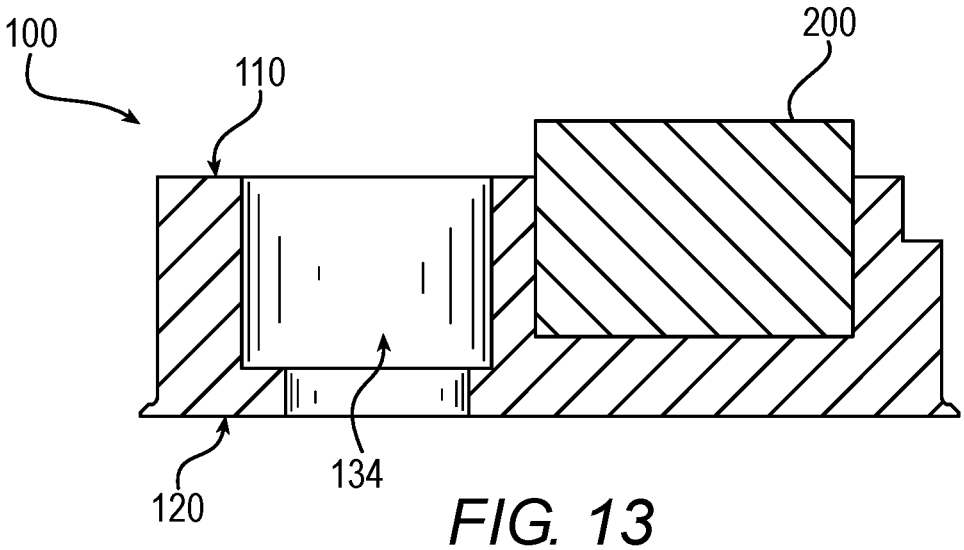
FIG. 13 is a cross-section of a manifold taken at line 13-13 of FIG. 8, in accordance with an example of the disclosure.

FIG. 13 is a cross-section of a manifold 100 taken at line 13-13 of FIG. 8. Here, again, the insert 200 is positioned within the recess 140 of the manifold. The recess 140 is formed in the bottom side 110 of the manifold 100. This cross-section illustrates a tube 334 positioned within the manifold 100 independent of the manifold 100. The tube 334 extends from the bottom side 110 of the manifold and is positioned within one of the plurality of openings 134 of the manifold. In this example, similar to the tubes 330, 332 and openings 230, 232 of the insert, the tube 334 extends partially through the manifold 100 and seated within the manifold 100 above the top side 120 of the manifold 100. In some examples, the tube 334 may be positioned within and extend through the opening 134 to or through the top side 120 of the manifold 100. In this example, the tube 334 is a supply tube 334 for supplying water to a faucet from the inlet tubes.

Figure 14A:
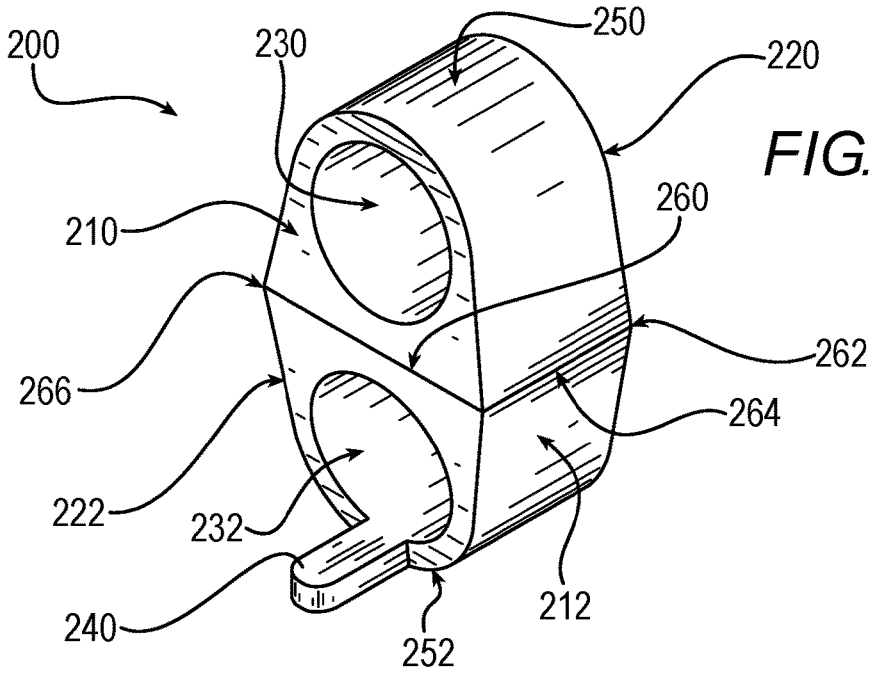
FIG. 14A is a bottom perspective view of an insert, in accordance with an example of the disclosure.
Figure 14B:
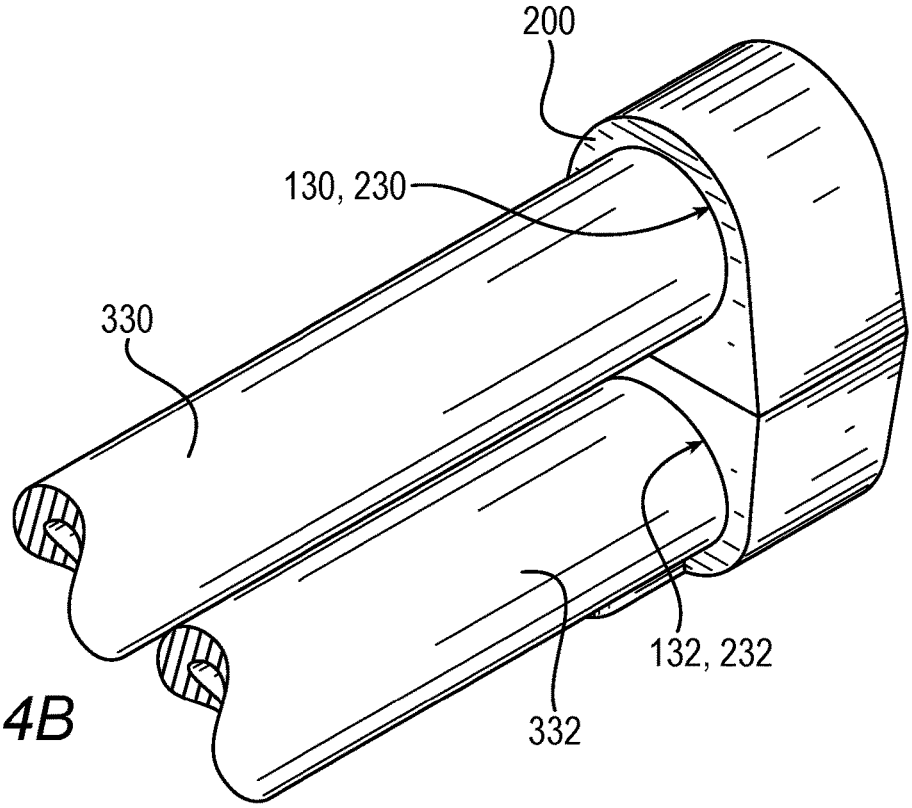
FIG. 14B is a bottom perspective view of an insert including tubes, in accordance with an example of the disclosure.
Figure 16:
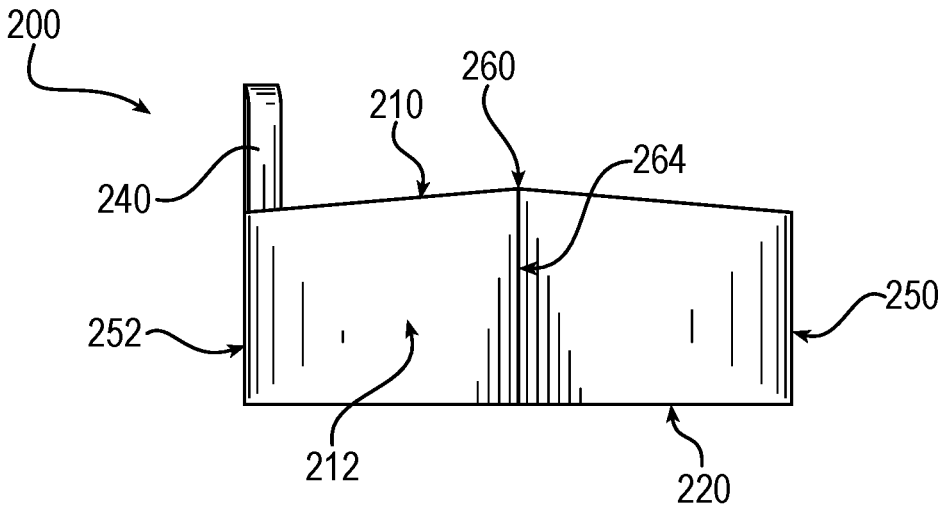
FIG. 16 is a side view of an insert, in accordance with an example of the disclosure.
Figure 17:
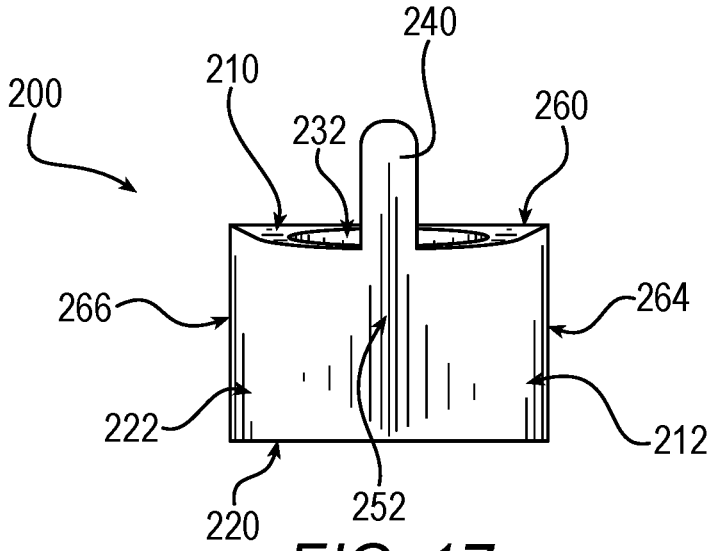
FIG. 17 is a side view of an insert, in accordance with an example of the disclosure.
Figure 18:
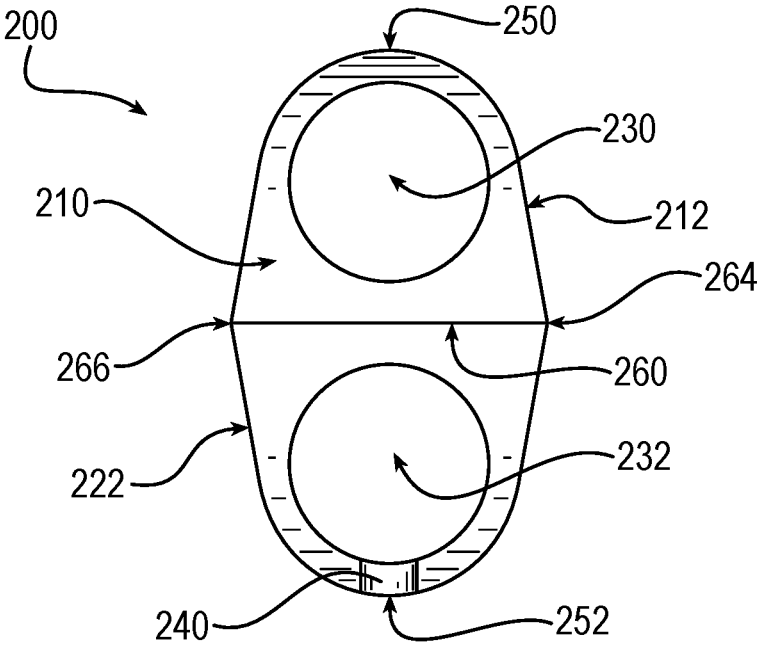
FIG. 18 is a bottom view of an insert, in accordance with an example of the disclosure.
Figure 19:
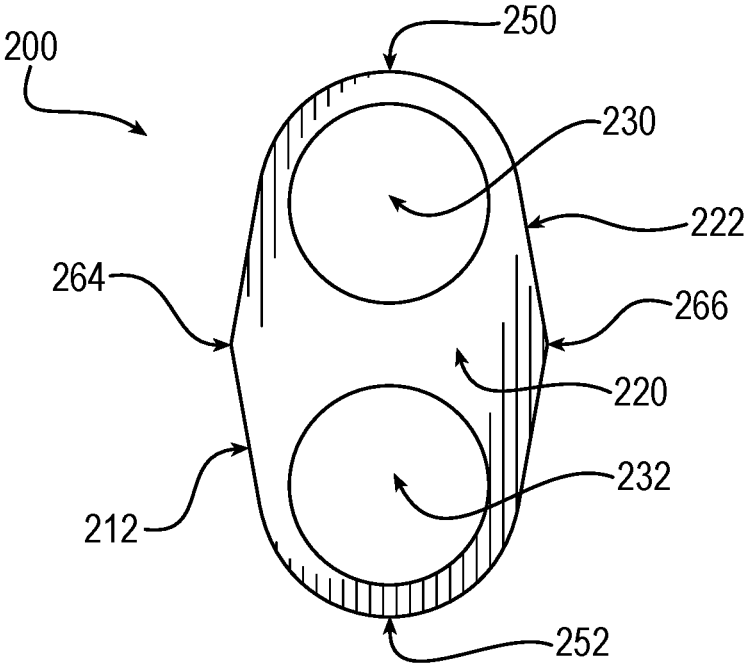
FIG. 19 is a top view of an insert, in accordance with an example of the disclosure.

FIGS. 14-19 illustrate an example of the insert 200 of the present disclosure. The insert 200 of the present disclosure may also be referred to as a combined insert as it is relied on to secure or align a pair of inlet tubes 330, 332 (e.g., a hot water inlet tube 330 and a cold water inlet tube 332) in a side-by-side arrangement within the insert. FIGS. 14-15 are bottom side perspective views of the insert 200, FIGS. 16-17 are side views of the insert 200, and FIGS. 18-19 are top and bottom views of the insert, respectively. In FIGS. 14A and 15A, the insert 200 comprises a bottom side 210 and a top side 220. A pair of openings 230, 232, or apertures, extend through the insert from the bottom side 210 to the top side 220. A protrusion 240 further extends from the bottom side 210 of the insert. The insert 200 is diamond shaped with apexes 250, 252 formed at each longitudinal end, relative the pair of openings 230, 232, or apertures. The insert also comprises peaks 260, 262, 264, 266 formed about its perimeter centrally positioned between the pair of openings 230, 232, or apertures. A first peak 260 is formed on the bottom side 210, a second peak 262 is formed on the top side 220, a third peak 264 is formed on a first lateral side 212 and a fourth peak 266 is formed on a second lateral side 222. Because peaks extend about the entire central section of the insert at a longitudinal center, the longitudinal center, relative the pair of openings 230, 232, or apertures, has a greater material depth and thickness than each of the openings of the pair of openings 230, 232, or apertures. A diamond shape is formed on each side of the insert with peaks on the bottom side 210, top side 220, first lateral side 212, and second lateral side 222. It is appreciated herein that the insert 200 may have a diamond shape at one or more or any combination of sides. It is also appreciated herein that the insert 200 may have any other shape such as, for example, rectangle, oval, circle, or the like. The shape of the insert as described above is described absent the protrusion 240, however, the insert may further comprise the protrusion 240 as illustrated and described herein. FIGS. 14B and 15B display the insert 200 along with the tubes 330, 332 attached as further described herein.

Turning now to FIG. 16, an example of a side view of an insert 200 from a first lateral side 212 is illustrated. In this example, only the bottom side 210, the first lateral side 212, and the second lateral side 222 possess a first peak 260, a third peak 264, and a fourth peak 266, respectively. In this example, the top side 220 is flat. The protrusion 240 extends from the bottom side of the insert. In FIG. 17, an example of a side view of an insert, from the apex 252 where the protrusion 240 extends from a bottom side 210 of the insert 200, is illustrated. An opening 232, or aperture, extends from the bottom side 210 of the insert 200 through the top side 220 of the insert 200. FIGS. 18 and 19 illustrate the bottom side 210 and top side 220 of the insert as described with respect to FIGS. 14-17 above, respectively.

Figure 20:
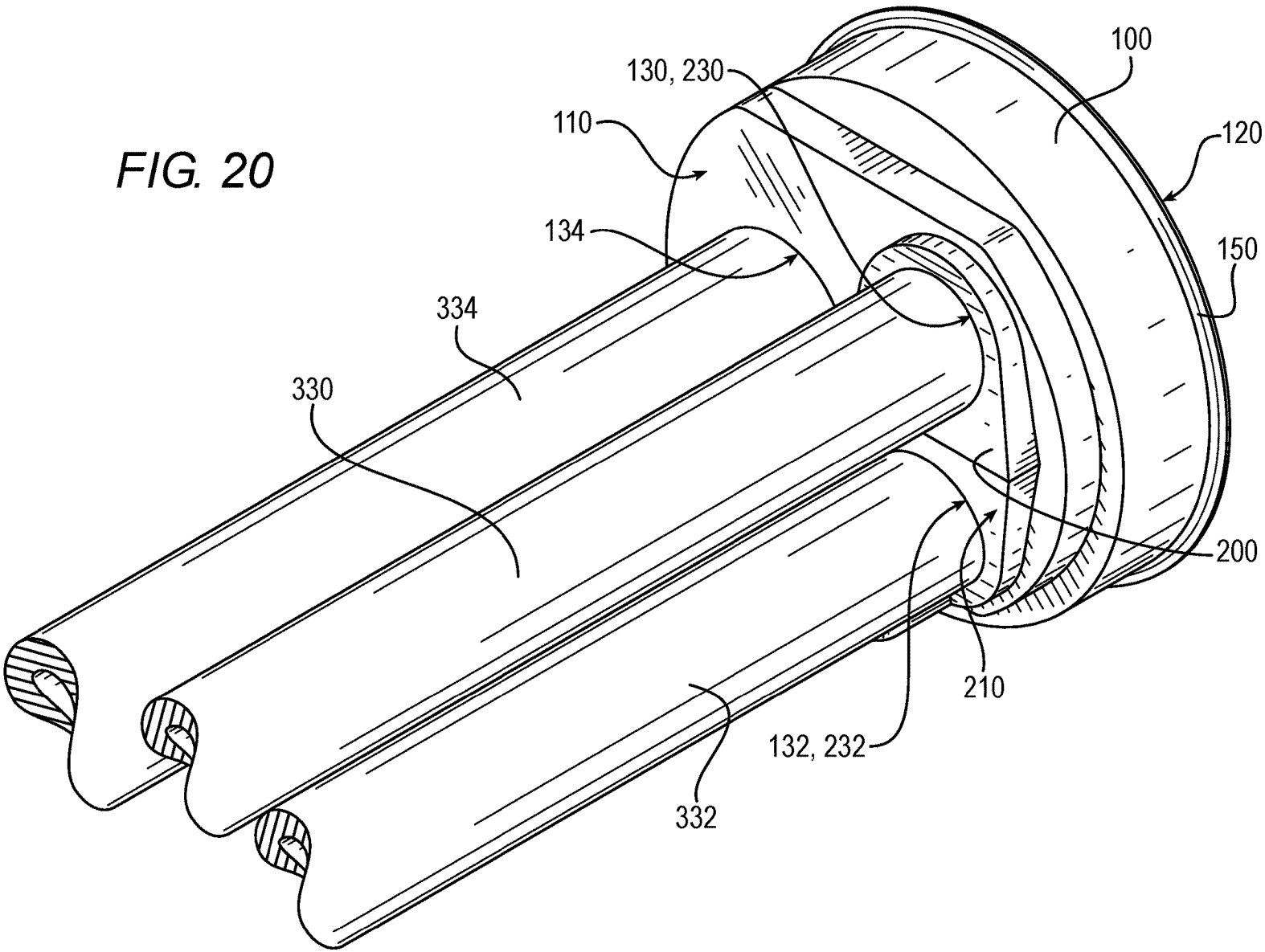
FIG. 20 is a bottom perspective view of a manifold, insert, and tubes, in accordance with an example of the disclosure.
Figure 21:
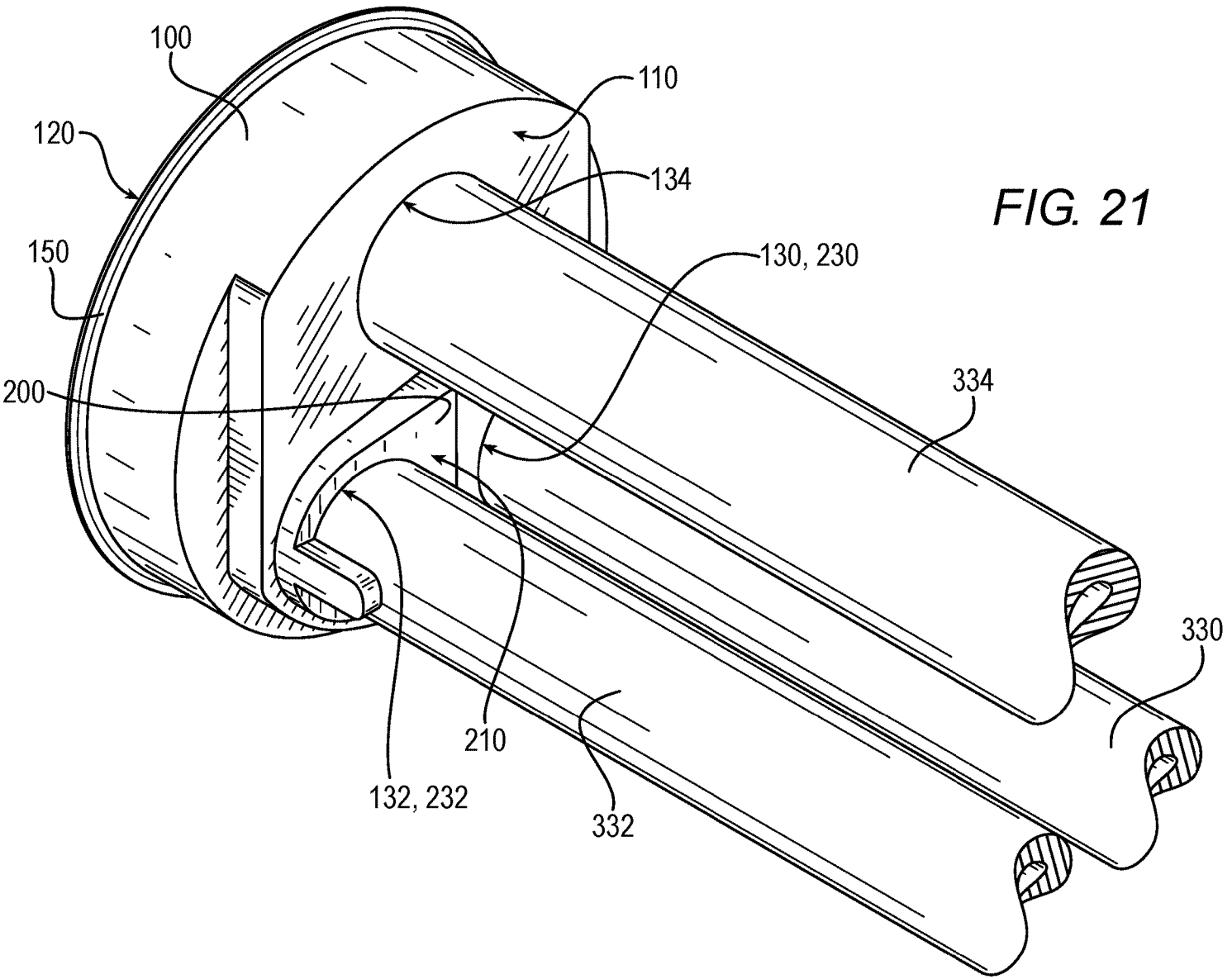
FIG. 21 is a bottom perspective view of a manifold, insert, and tubes, in accordance with an example of the disclosure.

FIGS. 20-21 are bottom side perspective view of a manifold 100 with an insert 200 and tubes 330, 332, 334. As noted above, the insert 200 is recessed in the bottom side 110 of the manifold 100 and extends from the bottom side 110 of the manifold. A hot water inlet tube 330 and a cold water inlet tube 332 extend from the bottom side 210 of the insert 200. The inlet tubes 330, 332 may extend partially through the insert 200, entirely through the insert 200, be positioned with insert 200 (and not extend into the manifold), extend through the insert 200 and be recessed in the manifold 100, and/or extend entirely through the insert 200 and the manifold. Regardless, the pair of openings 130, 132, or apertures, of the manifold 100 and the pair of openings 230, 232, or apertures, are open from the bottom side 210 of the insert 200 through the top side 220 of the insert 200 and the top side 120 of the manifold 100 forming a pathway therethrough. Similarly, a supply tube 334 extends from the bottom side 110 of the manifold, independent of the insert. The supply tube 334 may extend entirely through the entire manifold 100 from the bottom side 110 of the manifold 100 to the top side 120 of the manifold 100. The supply tube 334 may be recessed within the bottom side 110 of the manifold 100, thereby, not extending entirely to the top side 120 of the manifold. Regardless, the opening 134, or aperture, extending from the bottom side 110 of the manifold 100 is open through the top side 120 of the manifold 100 forming a pathway therethrough.

Figure 22:
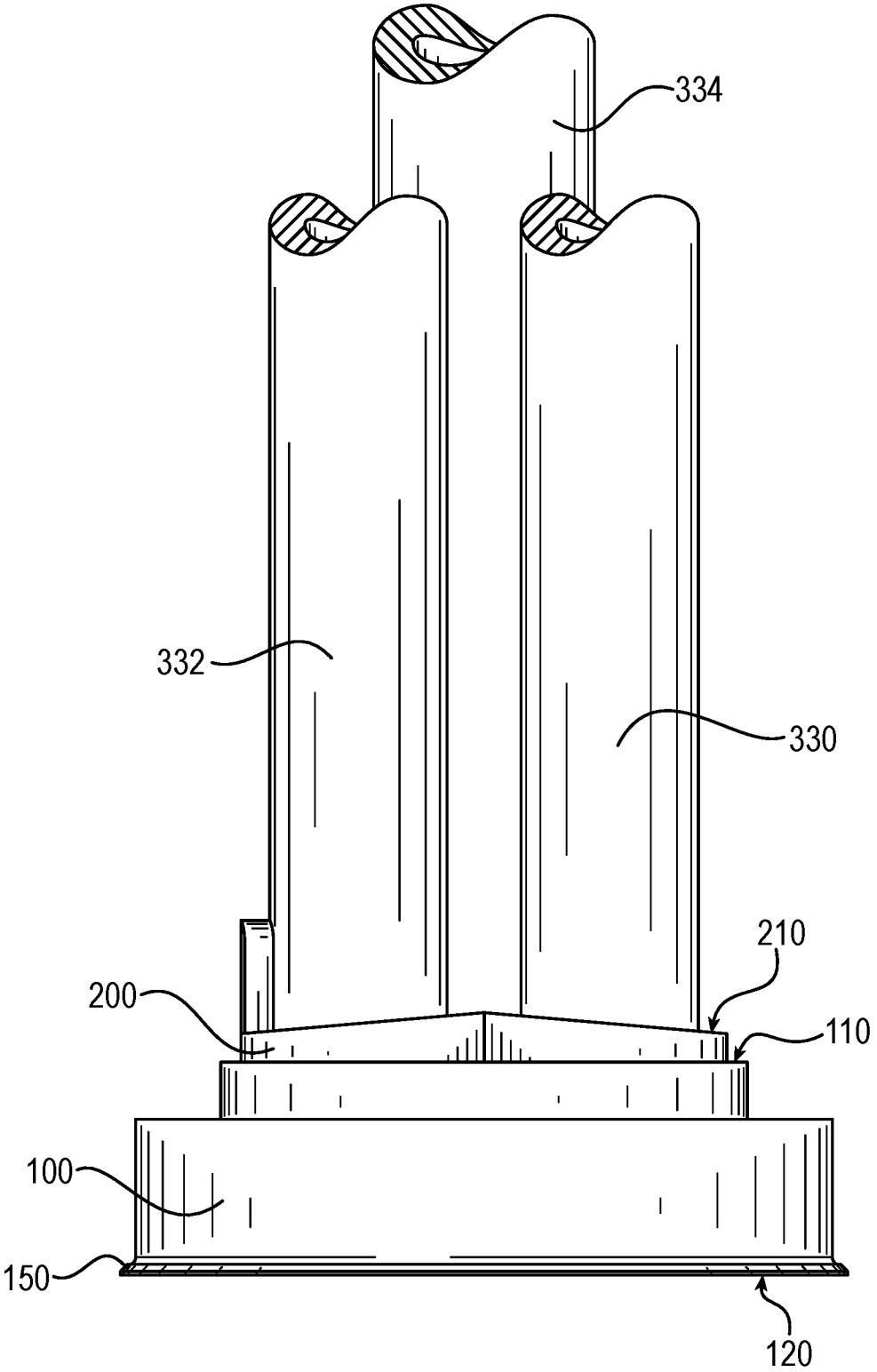
FIG. 22 is a side view of a manifold, insert, and tubes, in accordance with an example of the disclosure.
Figure 23:
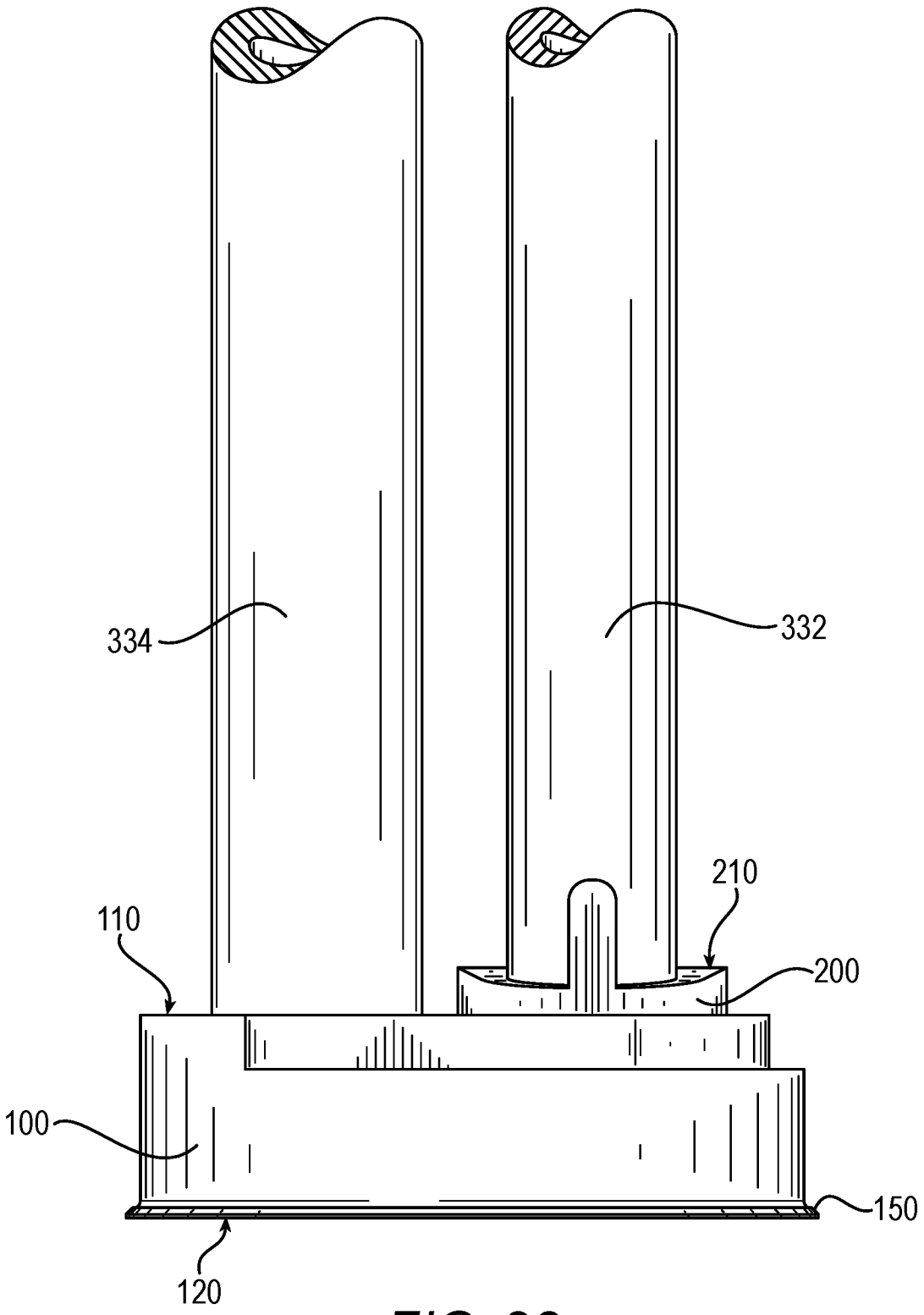
FIG. 23 is a side view of a manifold, insert, and tubes, in accordance with an example of the disclosure.

As illustrated by FIGS. 20-21, the supply tube 334 is offset from the insert 200. In other words, the supply tube 334 is offset from the pair of inlet tubes 330, 332 within the insert 200. In this example, a triangle arrangement is formed between the supply tube 334 and the pair of inlet tubes 330, 332 providing for a manifold 100 having a reduced diameter in comparison to a manifold having a pair of inlet tubes and a supply tube which are otherwise aligned. In this example, the inlet tubes 330, 332 and the supply tube 334 extend from the bottom side 110 of the manifold in the same direction. FIGS. 22-23 illustrate side views, rotated 90 degrees from one another, of a manifold 100 with an insert 200 and tubes 330, 332, 334, as described above in FIGS. 20-21.

In each of FIGS. 20-23, the top side 120, or perimeter, of the manifold 100 may sealingly couple with a valve assembly to form the waterway assembly where the valve assembly is in fluid communication with the plurality of openings, or apertures, extending through the manifold. In the example as illustrated by FIGS. 20-23, an annular sealing flange 150 is formed about the perimeter of the manifold 100 at the top side 120 of the manifold 100. The annular sealing flange 150 is formed with the manifold 100 and is an extension of the manifold 100. With further reference to FIG. 1, the manifold 100 may be inserted into the valve body 18 and the annular sealing flange 150 forms a leak-proof connection (illustratively, a lip seal 152) between the manifold 100 and the inner surface 16 of the valve body 18. With the leak-proof connection water may only enter the waterway assembly and valve assembly through the inlet tubes 330, 332 and exit the waterway assembly and the valve assembly through the supply tube 334. In specific examples, the annular sealing flange 150 replaces the need for a separate o-ring between the manifold 100 and the valve assembly. In other words, a leak-proof connection is formed between the manifold 100 and the valve assembly absent, free of, or without an o-ring.

Figure 24:
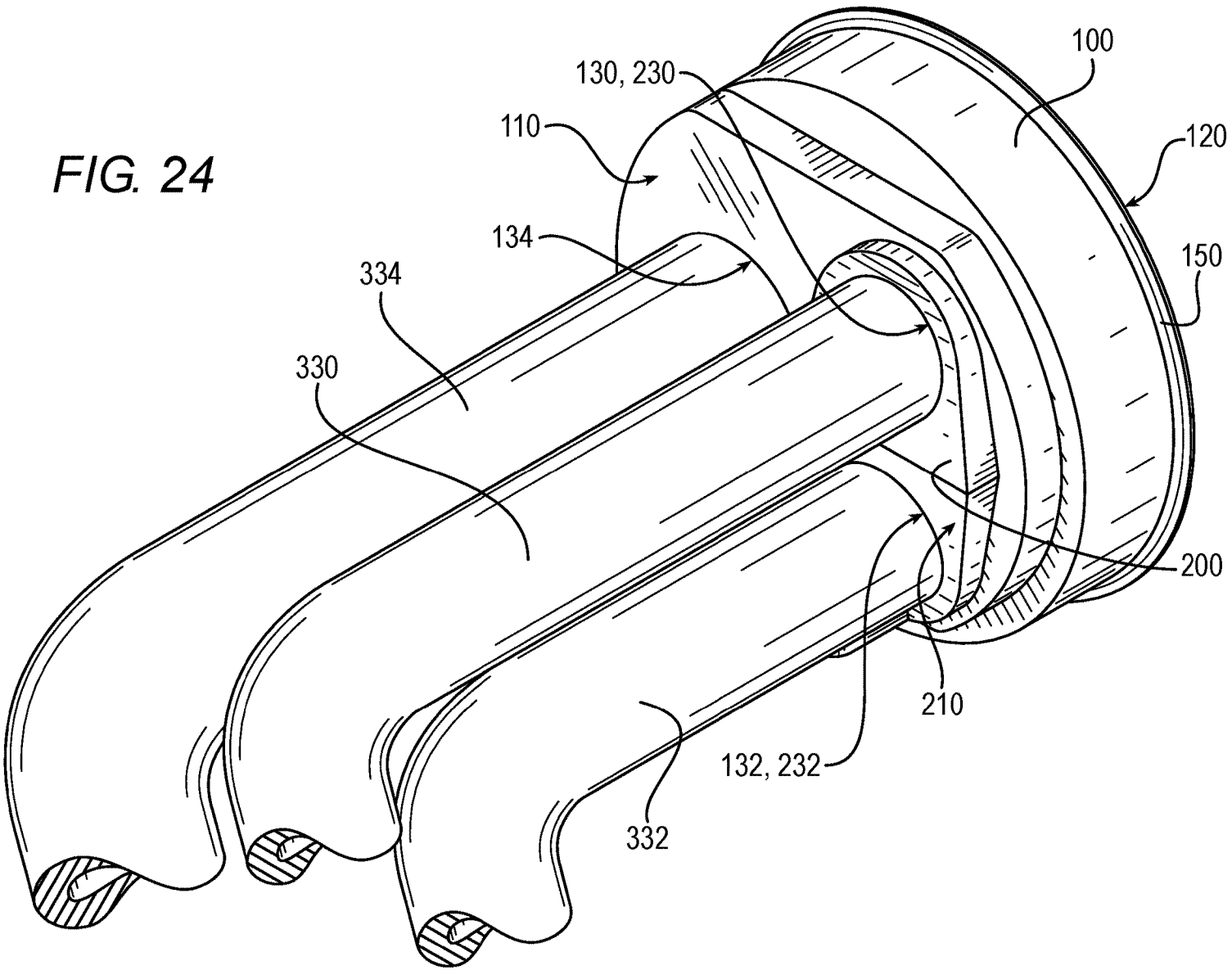
FIG. 24 is a perspective view of a manifold having curved tubes, in accordance with an example of the disclosure.
Figure 25:
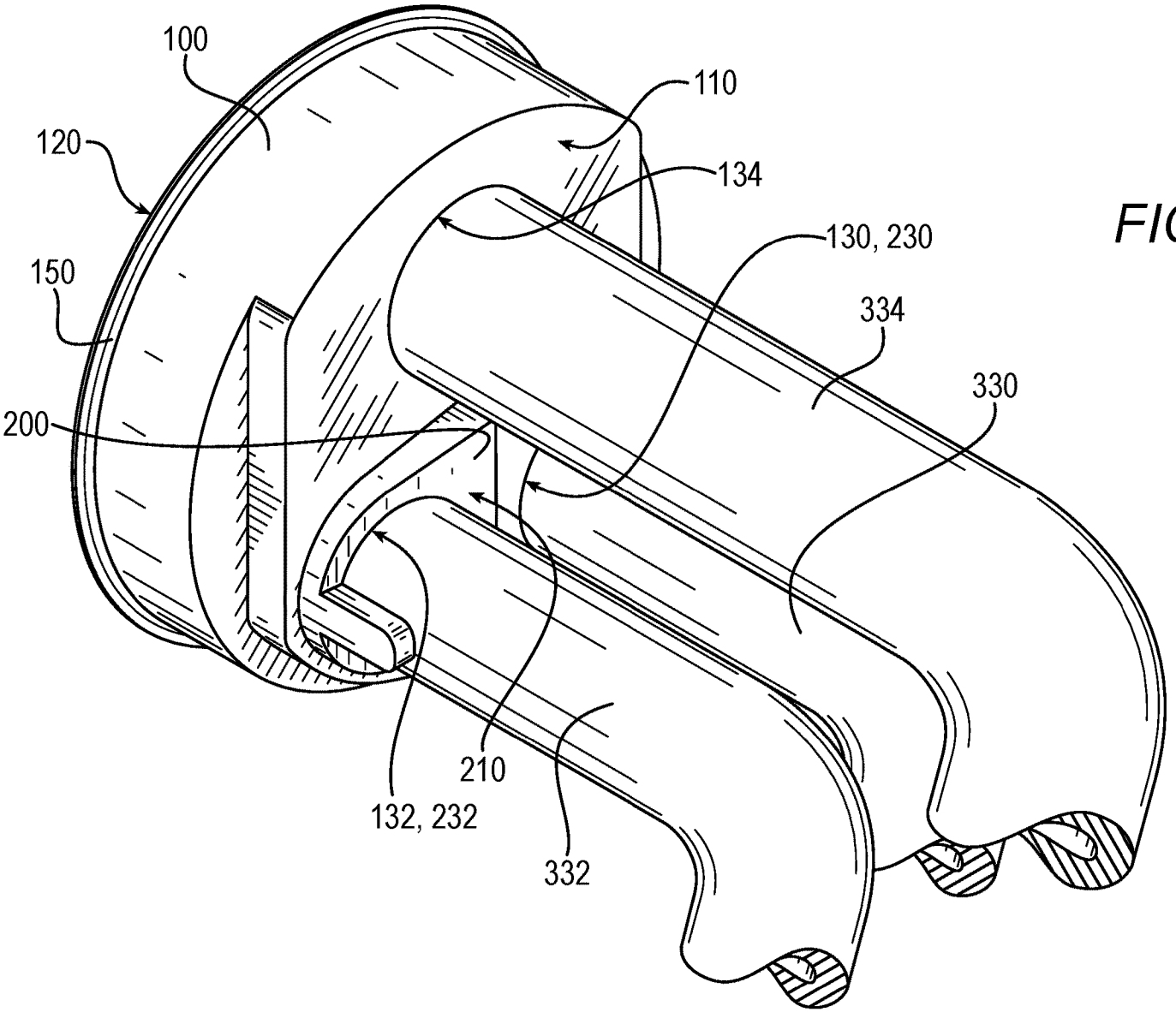
FIG. 25 is another perspective view of a manifold having curved tubes, in accordance with an example of the disclosure.

FIGS. 24-25 illustrate another example where the tubes 330, 332, 334 are curved. Curved inlet tubes may be provided in a faucet assembly where the valve assembly may be oriented to the side of a faucet body. By adding a respective curve 331, 333, 335 to the tubes 330, 332, 334 the manifold 100 may maintain alignment with the valve assembly which is now mounted to a side of a faucet assembly, as opposed to being in a vertical arrangement within the faucet assembly. By providing a curve 331, 333, 335 in the tubes the tubes 330, 332, 334 remain aligned (e.g. vertically) within the faucet assembly while the manifold 100 maintains proper alignment (e.g. horizontally) with a side mounted valve assembly. In this example, the curves 331, 333, 335 are each 90 degrees. The curves may vary between the tubes and/or vary from 90 degrees depending upon the faucet assembly. Because of tight spacing constraints the tubes may be pre-formed so they do not require adjustment or become deformed during assembly. Because of the offset nature of the inlet tubes 330, 332, within the insert 200, relative to the supply tube 334 within the manifold 100, as described above, the tubes are separated enough so that a mandrel may also be provided between the lower tubes (as they are positioned while being formed) in the forming operation in order to provide a support or forming surface for the upper tube. Once the tubes cool after the forming operation, they may return to a compact arrangement (e.g. triangular arrangement as described above) which allows for assembly into the faucet assembly.

A method for forming the manifold of the present disclosure is also disclosed herein. In the step for forming the manifold 100 of the present disclosure an insert 200 may first be formed. The step of forming the insert 200 may occur independent of forming the manifold 100. One or more inlet tubes 330, 332, such as a hot water inlet tube and/or a cold water inlet tube, may be secured within the insert 200. The one or more inlet tubes 330, 332 may be secured within the insert 200 by forming the insert about the one or more inlet tubes. In other words, the method for forming the manifold 200 of the present disclosure may comprise the first step of forming an insert 200 with one or more inlet tubes 330, 332 such as, for example, a hot water inlet tube and a cold water inlet tube, therein. To form the insert 200 about the one or more inlet tubes 330, 332, an end of one or more inlet tubes 330, 332 may be secured within a mold wherein the insert 200 is overmolded about the ends of the inlet tubes within the mold.

As used in this application, the term "overmold" means the process of injection molding a second polymer over a first polymer, wherein the first and second polymers may or may not be the same. In one example of the disclosure, the composition of the overmolded polymer will be such that it will be capable of at least some melt fusion with the composition of the polymeric tube. There are several means by which this may be affected. One of the simplest procedures is to ensure that at least a component of the polymeric tube and that of the overmolded polymer is the same. Alternatively, it would be possible to ensure that at least a portion of the polymer composition of the polymeric tube and that of the overmolded polymer is sufficiently similar or compatible so as to permit the melt fusion or blending or alloying to occur at least in the interfacial region between the exterior of the polymeric tube and the interior region of the overmolded polymer. Another manner in which to state this would be to indicate that at least a portion of the polymer compositions of the polymeric tube and the overmolded polymer are miscible. In contrast, the chemical composition of the polymers may be relatively incompatible, thereby not resulting in a material-to-material bond after the injection overmolding process.

The method for forming the manifold of the present disclosure may further comprise a step of inserting or positioning the insert 200 (and inlet tubes 330, 332) into the manifold 100. In addition to the step of inserting or positioning the insert 200 into the manifold 100, one or more additional tubes (i.e. a supply tube) 334 may also be inserted or positioned into the manifold 100. In one example, the step of inserting or positioning the insert 200 (and inlet tubes 330, 332) into the manifold 100 and inserting or positioning the one or more additional tubes 334 into the manifold 100 is done by overmolding. In this example, the insert 200 (and inlet tubes 330, 332) and an end of the supply tube 334 may be secured within a mold wherein the manifold 100 is overmolded about the insert 200 and the end of the supply tube 334 within the mold.

The above described method is a two-step overmolding process, where the first step is overmolding the diamond-shaped insert 210 about the two inlet tubes 330, 332. The next step is overmolding the manifold 100 around the diamond-shaped insert 200 and the supply tube 334. The result is a triangular tube orientation which is very compact and reduces the overall size or diameter of the manifold 100. The challenge with molding a manifold with a triangular tube orientation is the mold steel for the top or bottom half of the mold must close or wrap around 180 degrees of each tube. If a portion of one tube overlaps with another tube (such as the triangular tube orientation) in the direction of pull of the mold, the steel to form that 180 degree tube shutoff surface is trapped and therefore the mold cannot be opened. By first molding the two inlet tubes 330, 332 together in the insert 200, and then inserting that insert 200 into the manifold mold along with the third tube 334 in the second molding step, it is possible to achieve the triangular tube configuration in the manifold 100.

The diamond-shaped insert 200 provides the needed sealing surfaces that keep plastic from leaking past this component during the second overmolding step. The diamond shape provides optimized "shutoffs" which are the interface surfaces or lateral sides 212, 222 between the diamond-shaped insert 200 and the corresponding cavity in the manifold overmold tooling. These surfaces act as a lateral seal when the mold is closed by pressing out against the steel surfaces of the manifold mold and preventing plastic from leaking around the diamond-shaped insert 200. The top face 210 of the diamond-shaped insert 210 is angled similarly to the lateral sides 212, 222 for the same reason. The diamond-shaped insert 200 is therefore locked into position in both the X and Y axis when clamped into the manifold overmold.

In another example, the one or more additional tubes 334 may be secured within the mold such that the one or more additional tubes extend entirely through the manifold and are flush with the bottom side of the manifold after overmolding. Likewise, the inlet tubes 330, 332 may extend entirely through the insert 200 and into the manifold 100 or may extend through the manifold 100 such that they are flush with the top side 120 of the manifold 100 after overmolding. Regardless of the arrangement of the insert each of the tubes are in fluid communication with or form the respective openings through the manifold for transfer of water through the manifold and ultimately to and from a valve assembly of a waterway assembly.

The method for forming the manifold of the present disclosure may further comprise a step of inserting the insert 200 into the mold of the manifold using the protrusion 240 as a visual indicator to indicate that the insert has been properly placed. In one example, the hot inlet tube 330 includes a red color code and the cold inlet tube 332 includes a blue color code prior to overmolding the manifold. In order to have the hot inlet tube 330 and cold inlet tube 332 properly installed in a valve assembly, the insert 200 must be oriented properly before being placed in the mold for the manifold. The protrusion 240, located adjacent either the hot inlet tube 330 or cold inlet tube 332, allows the production operator to load the insert 200 (and hot and cold inlet tubes 330, 332) the same and correct way into the mold for the manifold. Without this visual indicator, the production operator could easily inadvertently reverse the hot and cold inlet tubes in the mold for the manifold.

A method of forming a waterway assembly may comprise the above steps of forming a manifold. The method for forming a waterway assembly may further comprise a step of forming a leak-proof connection between the manifold and a valve assembly. This may comprise a step of inserting the manifold into a valve assembly. Moreover, the step of forming a leak-proof connection between the manifold and the valve assembly may include forming a seal between the valve assembly and the manifold by way of an annular sealing flange formed on the manifold. Moreover, the leak-proof connection between the manifold and the valve assembly may be formed absent, free of, or without an o-ring.

In a method of use for the waterway assembly above, steps for use may further include a step of mixing water, or fluid, between the manifold and the valve assembly. More specifically, the method of use for the waterway assembly may comprise a step of supplying hot water to the valve assembly through the manifold by way of the hot water inlet tube, supply cold water to the valve assembly through the manifold by way of the cold water inlet tube, and/or mixing hot water and cold water between the mixing valve and controlling the flow of water through the waterway assembly by way of the mixing valve and releasing the water from the manifold through the supply tube.

Examples of the present disclosure include apparatus and processes by which a leak-proof connection with one or more tubes, such as polymeric tubes, is achieved, such as when a leak-proof connection is formed between the manifold, the insert, and the one or more tubes and when a leak-proof connection is formed between the insert and the inlet tubes.

In one example of this disclosure, the polymeric tubing is made from high density polyethylene which is crosslinked. Additionally, the manifold and/or the insert may be crosslinked. Moreover, the entire waterway assembly may be crosslinked. PEX contains crosslinked bonds in the polymer structure changing the thermoplastic into a thermoset. Crosslinking may be accomplished during or after the molding of the part. The required degree of crosslinking for crosslinking polyethylene tubing, according to ASTM Standard F 876, is between 65-89%. There are three classifications of PEX, referred to as PEX-A, PEX-B, and PEX-C. PEX-A is made by peroxide (Engel) method. In the PEX-A method, peroxide blending with the polymer performs crosslinking above the crystal melting temperature. The polymer is typically kept at high temperature and pressure for long periods of time during the extrusion process. PEX-B is formed by the silane method, also referred to as the "moisture cure" method. In the PEX-B method, silane blended with the polymer induces crosslinking during molding and during secondary post-extrusion processes, producing crosslinks between a crosslinking agent. The process is accelerated with heat and moisture. The crosslinked bonds are formed through silanol condensation between two grafted vinyltrimethoxysilane units. PEX-C is produced by application of an electron beam using high energy electrons to split the carbon-hydrogen bonds and facilitate crosslinking.

Crosslinking imparts shape memory properties to polymers. Shape memory materials have the ability to return from a deformed state (e.g., temporary shape) to their original crosslinked shape (e.g., permanent shape), typically induced by an external stimulus or trigger, such as a temperature change. Alternatively, or in addition to temperature, shape memory effects can be triggered by an electric field, magnetic field, light, or a change in pH, or even the passage of time. Shape memory polymers include thermoplastic and thermoset (covalently crosslinked) polymeric materials.

Shape memory materials are stimuli-responsive materials. They have the capability of changing their shape upon application of an external stimulus. A change in shape caused by a change in temperature is typically called a thermally induced shape memory effect. The procedure for using shape memory typically involves conventionally processing a polymer to receive its permanent shape, such as by molding the polymer in a desired shape and crosslinking the polymer defining its permanent crosslinked shape. Afterward, the polymer is deformed and the intended temporary shape is fixed. This process is often called programming. The programming process may consist of heating the sample, deforming, and cooling the sample, or drawing the sample at a low temperature. The permanent crosslinked shape is now stored while the sample shows the temporary shape. Heating the shape memory polymer above a transition temperature $T_{trans}$ induces the shape memory effect providing internal forces urging the crosslinked polymer toward its permanent or crosslinked shape. Alternatively or in addition to the application of an external stimulus, it is possible to apply an internal stimulus (e.g., the passage of time) to achieve a similar, if not identical result.

A chemical crosslinked network may be formed by low doses of irradiation. Polyethylene chains are oriented upon the application of mechanical stress above the melting temperature of polyethylene crystallites, which can be in the range between 60° C. and 134° C. Materials that are most often used for the production of shape memory linear polymers by ionizing radiation include high density polyethylene, low density polyethylene and copolymers of polyethylene and poly(vinyl acetate). After shaping, for example, by extrusion or compression molding, the polymer is covalently crosslinked by means of ionizing radiation, for example, by highly accelerated electrons. The energy and dose of the radiation are adjusted to the geometry of the sample to reach a sufficiently high degree of crosslinking, and hence sufficient fixation of the permanent shape.

Another example of chemical crosslinking includes heating poly(vinyl chloride) under a vacuum resulting in the elimination of hydrogen chloride in a thermal dehydrocholorination reaction. The material can be subsequently crosslinked in an HCl atmosphere. The polymer network obtained shows a shape memory effect. Yet another example is crosslinked poly[ethylene-co-(vinyl acetate)] produced by treating the radical initiator dicumyl peroxide with linear poly[ethylene-co-(vinyl acetate)] in a thermally induced crosslinking process. Materials with different degrees of crosslinking are obtained depending on the initiator concentration, the crosslinking temperature and the curing time. Covalently crosslinked copolymers made from stearyl acrylate, methacrylate, and N,N'-methylenebisacrylamide as a crosslinker.

Additionally, shape memory polymers include polyurethanes, polyurethanes with ionic or mesogenic components, block copolymers consisting of polyethylene terephthalate and polyethylene oxide, block copolymers containing polystyrene and poly(1,4-butadiene), and an ABA triblock copolymer made from poly(2-methyl-2-oxazoline) and a poly (tetrahydrofuran). Further examples include block copolymers made of polyethylene terephthalate and polyethylene oxide, block copolymers made of polystyrene and poly(1,4-butadiene) as well as ABA triblock copolymers made from poly(tetrahydrofuran) and poly(2-methyl-2-oxazoline). Other thermoplastic polymers which exhibit shape memory characteristics include polynorbornene, and polyethylene grated with nylon-6 that has been produced for example, in a reactive blending process of polyethylene with nylon-6 by adding maleic anhydride and dicumyl peroxide.

As previously noted, the manifold and the insert may be overmolded around the ends of a set of tubes to form a leak proof connection and subsequently crosslinked. Alternatively, the insert and manifold may be separately molded and crosslinked, and secured together by shape memory to form a leak proof connection. In this example, the tubes are also separately crosslinked and may be press fit into the openings of the insert and manifold and secured by shape memory to form a leak proof connection. Similarly, the insert may be press fit into the recess of the manifold and secured by shape memory to form a leak proof connection. In yet another example, the ends of the tubes may further include a fitting, such as barb, and may be press fit into the openings of the insert and manifold to form a leak proof connection.

While the disclosure has been illustrated and described in detail in the drawings and foregoing description, the same is to be considered as illustrative and not restrictive in character, it being understood that only example embodiments have been shown and described and that all changes and modifications that come within the spirit of the invention are desired to be protected by the appended claims and the equivalents thereof.

What is claimed is:

1. A waterway assembly comprising:

a manifold having a top side, a bottom side, a plurality of openings open through the top side and the bottom side and a recess formed in the bottom side and wherein a pair of openings of the plurality of openings extend through the bottom side within the recess;

an insert positioned in the recess of the manifold with the pair of openings of the plurality of openings extending therethrough;

at least one opening of the plurality of openings being positioned outside of the recess; and a tube extending from each of the plurality of openings whereby a pair of tubes of the tubes extending from each of the plurality of openings are positioned within the insert and a third tube of the tubes extending from each of the plurality of openings is positioned in the manifold in the at least one opening of the plurality of openings.

2. The waterway assembly of claim 1, wherein a first tube of the pair of tubes is a hot water inlet tube and a second tube of the pair of tubes is cold water inlet tube.

3. The waterway assembly of claim 2, wherein the third tube of the tubes extending from each of the plurality of openings is a supply tube.

4. The waterway assembly of claim 3, wherein the pair of inlet tubes are offset from the supply tube.

5. The waterway assembly of claim 4, wherein the supply tube is orientated at an acute angle relative to the hot water inlet tube and the cold water inlet tube.

6. The waterway assembly of claim 3, wherein the hot water inlet tube, the cold water inlet tube, and the supply tube form a triangular arrangement.

7. The waterway assembly of claim 1, wherein the insert is diamond shaped.

8. The waterway assembly of claim 1, further comprising a valve body, and a valve assembly received within the valve body, wherein the valve assembly is in fluid communication with the plurality of openings at the top side of the manifold.

9. The waterway assembly of claim 8, wherein a leak-proof connection is formed between the manifold and the valve body by an annular sealing flange formed by an integral extension of the manifold.

10. The waterway assembly of claim 9, wherein the leak-proof connection is formed between the manifold and the valve body without a separate sealing member.

11. The waterway assembly of claim 1, wherein the manifold is 25 mm or less in diameter.

12. The waterway assembly of claim 1, wherein the diameter of the manifold is less than the diameter of each tube extending from each of the plurality of openings combined.

13. The waterway assembly of claim 1, wherein the manifold is overmolded about the insert.

14. The waterway assembly of claim 1, wherein the insert and the manifold comprise polyethylene.

15. The waterway assembly of claim 1, wherein the insert is overmolded about the pair of tubes.

16. The waterway assembly of claim 15, wherein the manifold is overmolded about the third tube of the tubes and the insert.

17. The waterway assembly of claim 15, wherein the tubes extending from the plurality of openings comprise polyethylene.

18. A combined insert for a waterway assembly comprising:

an insert body, a hot water inlet tube, and a cold water inlet tube wherein the hot water inlet tube and the cold water inlet tube are arranged adjacent one another within the insert body;

and wherein the insert body is configured to be inserted into a manifold having a supply tube positioned independent and outside of the insert body for transferring water from the cold water inlet tube and the hot water inlet tube through a valve assembly to the supply tube.

19. The combined insert of claim 18, wherein the hot water inlet tube and the cold water inlet tube transfer a fluid through the insert body for mixing between the valve assembly and the manifold the combined insert is positioned within.

20. The combined insert of claim 18, further comprising a protrusion extending from a bottom side of the insert body and adjacent either the hot water inlet tube or the cold water inlet tube.

21. The combined insert of claim 18, wherein the insert body is overmolded about the hot water inlet tube and the cold water inlet tube.

22. The combined insert of claim 18, wherein the insert body, the hot water inlet tube, and the cold water inlet tube comprise polyethylene.

23. The combined insert of claim 18, wherein the insert body is diamond shaped.

24. A waterway assembly comprising:

an insert, a hot water inlet tube, and a cold water inlet tube wherein the hot water inlet tube and the cold water inlet tube are arranged adjacent one another within the insert, a manifold having a top side, a bottom side, a plurality of openings open through the top side and the bottom side and a recess formed in the bottom side and the insert positioned in the recess of the manifold with the hot water inlet tube and the cold water inlet tube open through a pair of openings of the plurality of openings of the manifold; and a supply tube positioned within the manifold independent of the insert and outside of the insert.

25. The waterway assembly of claim 24, wherein the insert is diamond shaped.

26. The waterway assembly of claim 24, wherein the hot water inlet tube, the cold water inlet tube, and the supply tube form a triangular arrangement.

27. The waterway assembly of claim 24, further comprising a valve body, and a valve assembly received within the valve body, wherein the valve assembly is in fluid communication with the hot water inlet tube, the cold water inlet tube, and the supply tube from the top side of the manifold.

28. The waterway assembly of claim 27, wherein a leak-proof connection is formed between the manifold and the valve body by an annular sealing flange formed by an integral extension of the manifold.

29. The waterway assembly of claim 28, wherein the leak-proof connection is formed between the manifold and the valve body without a separate sealing member.

30. The waterway assembly of claim 24, wherein the manifold is overmolded about the insert.

31. The waterway assembly of claim 24, wherein the insert and the manifold comprise polyethylene.

32. The waterway assembly of claim 24, wherein the insert is overmolded about the hot water inlet tube and the cold water inlet tube.

33. The waterway assembly of claim 24, wherein the manifold is overmolded about the supply tube.

34. A method of forming a waterway assembly including the steps of:

providing a hot water inlet tube and a cold water inlet tube;

securing an end of the hot water inlet tube and an end of the cold water inlet in an insert mold;

overmolding an insert about the ends of the hot water inlet tube and the cold water inlet tube;

removing the insert and the ends of the hot water inlet tube and the cold water inlet tube from the mold;

providing a supply water tube;

securing an end of the supply water tube and the insert in a manifold mold; and overmolding a manifold about the end of the supply water tube and the insert whereby the end of the supply water tube is positioned within the manifold independent of the insert and outside of the insert.

35. The method of forming a waterway assembly of claim 34, wherein the step of overmolding the manifold includes forming the manifold having a top side and a bottom side with a plurality of openings open through the top side and the bottom side, the supply tube extending from one of the openings of the plurality of openings, and a recess formed in the bottom side wherein the insert is located in the recess, and wherein the hot water inlet tube and the cold water inlet tube are in fluid communication with a pair of openings of the plurality of openings and the supply tube is offset from the insert.

36. The method of forming a waterway assembly of claim 34, wherein the step of securing the insert in the manifold mold further comprises positioning the insert relative to a protrusion on the insert to define the proper orientation of the insert within the manifold mold.

37. The method of forming a waterway assembly of claim 34, further comprising a step of forming an integral annular sealing flange on the manifold to form leak-proof connection without a separate sealing member when a valve assembly is connected to the manifold.

38. The method of forming a waterway assembly of claim 34, further comprising the step of crosslinking the waterway assembly.

* * * * *